US011008191B2

(12) United States Patent
Yoshikane

(10) Patent No.: US 11,008,191 B2
(45) Date of Patent: May 18, 2021

(54) TRANSFER MECHANISM AND BAG SUPPLY APPARATUS

(71) Applicant: TOYO JIDOKI CO., LTD., Tokyo (JP)

(72) Inventor: Tohru Yoshikane, Iwakuni (JP)

(73) Assignee: TOYO JIDOKI CO., LTD., Tokyo (JP)

( * ) Notice: Subject to any disclaimer, the term of this patent is extended or adjusted under 35 U.S.C. 154(b) by 34 days.

(21) Appl. No.: 16/287,553

(22) Filed: Feb. 27, 2019

(65) Prior Publication Data

US 2019/0263617 A1 Aug. 29, 2019

(30) Foreign Application Priority Data

Feb. 28, 2018 (JP) ..... JP2018-035410
Jun. 26, 2018 (JP) ..... JP2018-121125

(51) Int. Cl.

| | |
|---|---|
| ***B65H 3/08*** | (2006.01) |
| ***B65H 5/12*** | (2006.01) |
| ***B65H 29/24*** | (2006.01) |
| ***B65H 31/00*** | (2006.01) |
| ***B65H 3/42*** | (2006.01) |

(Continued)

(52) U.S. Cl.

CPC ..... *B65H 29/241* (2013.01); *B31B 50/804* (2017.08); *B65B 43/16* (2013.01); *B65B 43/465* (2013.01); *B65H 3/0808* (2013.01); *B65H 3/42* (2013.01); *B65H 5/12* (2013.01); *B65H 31/00* (2013.01); *B65H 2701/191* (2013.01)

(58) Field of Classification Search

CPC ..... B65H 3/0808; B65H 3/42; B65H 5/12; B65H 2403/543; B65H 2701/191; B65B 43/465; B65B 43/46; B65B 43/50; B65B 43/16; B65B 43/165; B65B 43/18; B65B 43/185; B31B 15/804; B31B 50/804

See application file for complete search history.

(56) References Cited

U.S. PATENT DOCUMENTS

2009/0250866 A1* 10/2009 Wild ..... B65H 3/36 271/18
2012/0067697 A1* 3/2012 Gambetti ..... B65H 3/42 198/463.3
2020/0039768 A1* 2/2020 Persson ..... B65H 3/0883

FOREIGN PATENT DOCUMENTS

EP 1488916 A2 12/2004
EP 2431311 A1 3/2012

(Continued)

OTHER PUBLICATIONS

Extended European Search Report dated Jul. 8, 2019 issued in corresponding EP Application No. 19158873.0.

*Primary Examiner* — Luis A Gonzalez

(74) *Attorney, Agent, or Firm* — Pillsbury Winthrop Shaw Pittman, LLP

(57) ABSTRACT

A transfer mechanism includes a main rotating member, a first driving unit, a support mechanism, a holding unit, a second driving unit and control unit and transfers a sheet member from a pickup position to a delivery position. The support mechanism is connected to the main rotating member and the holding unit. The control unit controls the second driving unit in such a manner that, when the sheet member is placed in at least one of the pickup position and the delivery position, a position of the holding unit is not substantially changed in a state where the main rotating member rotates around the rotational axis in the first rotation direction.

16 Claims, 13 Drawing Sheets

(51) Int. Cl.

| | |
|---|---|
| ***B65B 43/16*** | (2006.01) |
| ***B31B 50/80*** | (2017.01) |
| ***B65B 43/46*** | (2006.01) |

(56) References Cited

FOREIGN PATENT DOCUMENTS

| | | | |
|---|---|---|---|
| JP | 04-006021 | A | 1/1992 |
| JP | 2001-341703 | A | 12/2001 |
| WO | 2005/019074 | A1 | 3/2005 |

* cited by examiner

TRANSFER MECHANISM AND BAG SUPPLY APPARATUS

CROSS-REFERENCE TO RELATED APPLICATIONS

This application is based upon and claims the benefit of priority from Japanese Patent Application No. 2018-35410, filed on Feb. 28, 2018 and Japanese Patent Application No. 2018-121125, filed on Jun. 26, 2018; the entire contents of which are incorporated herein by reference.

TECHNICAL FIELD

The present invention relates to a transfer mechanism and a bag supply apparatus to transfer a sheet member from a pickup position to a delivery position.

BACKGROUND ART

In general bag supply apparatuses, a swing arm as illustrated in FIG. 1 of Japanese patent application publication No. 4-6021 is often used. According to this type of device, a swing arm reciprocates between the position where a bag is to be taken out from a magazine (reservoir) and the position where a bag is delivered to a packaging machine side device (for example, a gripper or the like), so that pickup and delivery of a bag are carried out in a continuous manner.

Further, in the apparatus disclosed in Japanese patent application publication No. 2001-341703, a rotating member is used, and a suction holding member for picking up a bag is attached around the rotating member. When the rotating member rotates at a constant speed and the suction holding member is disposed at a pickup position above the magazine, the suction holding member is regulated by swinging the suction holding member in a direction opposite to the rotation direction of the rotating member.

SUMMARY OF INVENTION

Technical Problem

In the apparatus of Japanese patent application publication No. 4-6021, it is necessary to stop the swing arm, which can move back and forth, at the pickup position and the delivery position, and thus the swing arm moves at high speed while repeating acceleration and deceleration. Thus, there is concern that a heavy load may be applied to and accordingly vibrations are generated on the swing arm and the swing shaft, and as a result, problems such as damage to component parts of the apparatus may be caused. It is not easy to reciprocate the swing arm at a high speed while suppressing such increase in load and vibration, and complicated operation control will be required.

On the other hand, in the apparatus of Japanese patent application publication No. 2001-341703, it is possible to pick up bags at a high speed while suppressing loads and vibrations acting on each component of the apparatus, compared with the apparatus of Japanese patent application publication No. 4-6021. However, the apparatus of Japanese patent application publication No. 2001-341703 cannot stop a bag when the bag is delivered, and thus the kind of devices that can be used as the device for receiving a bag is limited. For example, when a bag is delivered to a gripper, it is necessary to cause the gripper to grip a predetermined portion of the bag such as a side edge portion, but it is difficult to grip, with high accuracy, the predetermined portion of a bag being moving by using the gripper. Therefore, in a case of using a gripper as a delivery device, the apparatus of Japanese patent application publication No. 2001-341703 is not optimum, and it is desirable that a transfer mechanism capable of stopping a bag at least when the bag is delivered should be used.

The present invention has been made in light of the above circumstances, and it is an object of the present invention to provide a transfer mechanism and a bag supply apparatus which can swiftly transfer a sheet member, such as a bag, from a pickup position to a delivery position while suppressing the movement of the sheet member when the sheet member is arranged at the pickup position and/or the delivery position.

Solution to Problem

One aspect of the present invention is directed to a transfer mechanism which moves a sheet member from a pickup position to a delivery position, the transfer mechanism comprising: a main rotating member; a first driving unit which rotates the main rotating member around a rotational axis in a first rotation direction; a support mechanism which is connected to the main rotating member; a holding unit which is connected to the support mechanism and is capable of holding the sheet member; a second driving unit which drives the support mechanism; and a control unit which controls the second driving unit, wherein: the support mechanism adjusts a relative position of the holding unit with respect to the main rotating member, and the control unit controls the second driving unit in such a manner that, when the sheet member is placed in at least one of the pickup position and the delivery position, a position of the holding unit is not substantially changed in a state where the main rotating member rotates around the rotational axis in the first rotation direction.

Desirably, a receiving device is provided in a position corresponding to the delivery position, and the control unit controls the second driving unit in such a manner that, when the sheet member is placed in the delivery position, the position of the holding unit is not substantially changed at least during a time when the sheet member is delivered from the holding unit to the receiving device.

Desirably, the control unit controls the second driving unit in such a manner that, when the holding unit holds the sheet member placed in the pickup position, the position of the holding unit is not substantially changed for a temporary period of time.

Desirably, a plurality of support mechanisms are provided, a plurality of holding units which are connected to the plurality of support mechanisms respectively are provided, and the plurality of holding units are arranged at equal angular intervals in a rotation direction around the rotational axis.

Desirably, the support mechanism includes: a mounting plate which supports the holding unit in a fixed manner; a first connection body which is provided to be swingable around the rotational axis, one side of the first connection body being rotatably connected to one side of the mounting plate, another side of the first connection body being rotatable around the rotational axis; a second connection body, one side of the second connection body being rotatably connected to another side of the mounting plate; a third connection body, one side of the third connection body being rotatably connected to another side of the second connection body; and a fourth connection body which rotates around the rotational axis along with the main rotating member and supports another side of the third connection body in a fixed manner, one side of the fourth connection body being rotatably supported by the main rotating member.

Desirably, the transfer mechanism comprises a third driving unit which drives the holding unit, wherein: the holding unit has a grip unit which is capable of opening and closing, and the third driving unit causes the grip unit to open and close in such a manner that, when the holding unit is caused to hold the sheet member, the grip unit is closed in such a manner that the grip unit grips the sheet member, and when the holding unit is caused to release the sheet member, the grip'unit is opened in such a manner that the grip unit releases the sheet member.

Desirably, the third driving unit includes: a rotation guide member which has a guide surface and is capable of rotating around the rotational axis independently of the main rotating member, a distance of the guide surface from the rotational axis in a direction perpendicular to the rotational axis varying in a rotation direction; a guide power unit which causes the rotation guide member to rotate around the rotational axis; a guide relay unit which moves on the guide surface; and an open-close unit which is connected to the guide relay unit and the grip unit and causes the grip unit to open and close according to a distance of the guide relay unit on the guide surface from the rotational axis.

Desirably, the support mechanism includes: a guide member which has a cam groove; and a cam body which is connected to the main rotating member and is placed in the cam groove, a distance of the cam groove from the rotational axis in a direction perpendicular to the rotational axis varies in a rotation direction, the cam body is guided along the cam groove according to rotation of the main rotating member, and the support mechanism is driven by the second driving unit and is driven according to a position of the cam body in the cam groove.

Another aspect of present invention is directed to a bag supply apparatus comprising: a transfer mechanism defined described above; a placement unit which places a sheet member in the pickup position; and a receiving device which receives a sheet member placed in the delivery position, wherein the sheet member is a bag.

According to the present invention, it is possible to swiftly transfer a sheet member, such as a bag, from a pickup position to a delivery position while suppressing movement of the sheet member when the sheet member is placed in the pickup position and/or the delivery position while.

DESCRIPTION OF EMBODIMENTS

An embodiment of the present invention will be described with reference to drawings. In the embodiment described below, a transfer mechanism 10 is applied to a bag supply apparatus 100, and sheet members which are transferred from a pickup position P1 to a delivery position P2 by the transfer mechanism 10 is empty bags B. However, the transfer mechanism 10 may be applied to apparatuses other than such a bag supply apparatus, and a sheet member other than a bag B may be transferred by the transfer mechanism 10.

[Bag Supply Apparatus]

Figure 1:
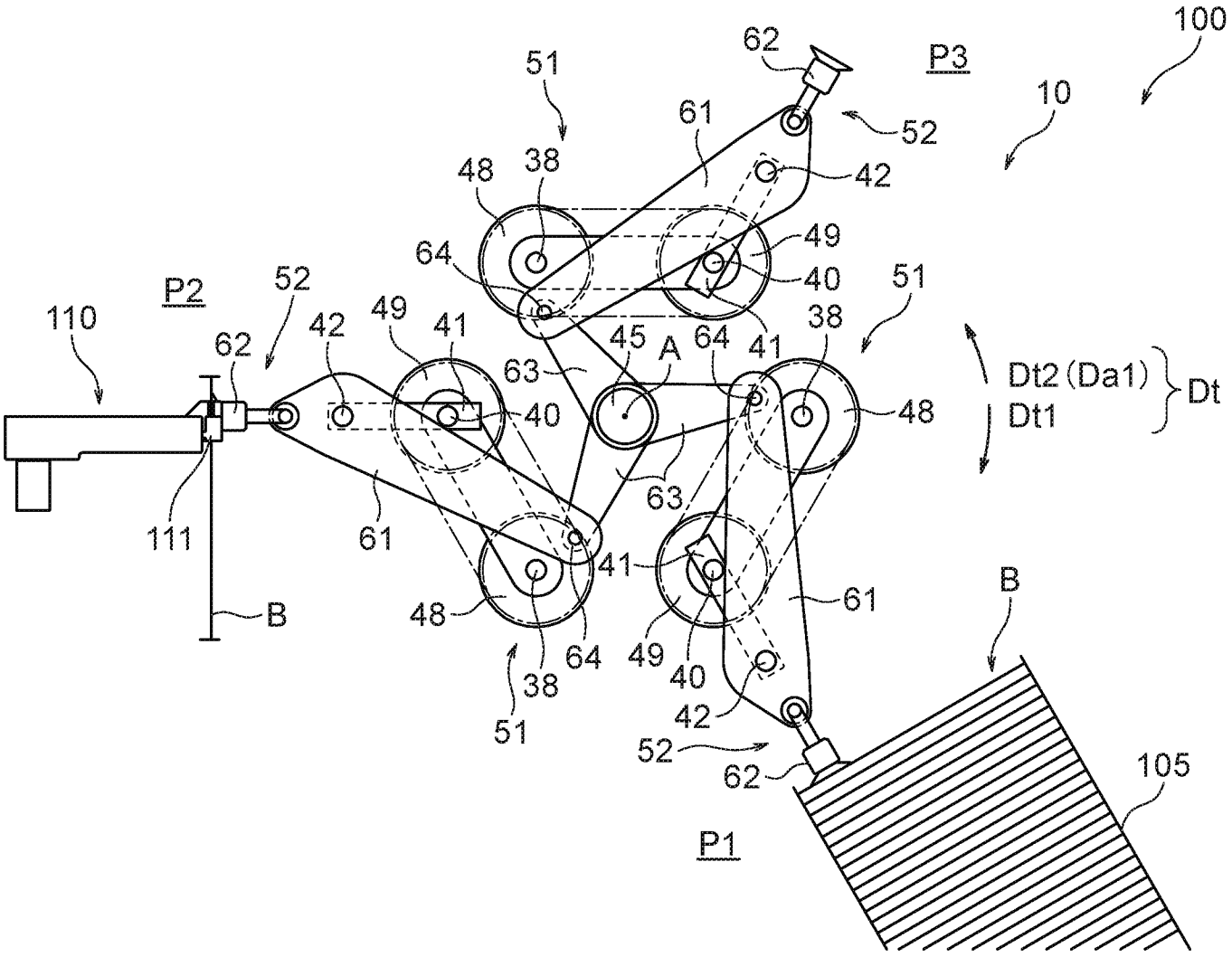
FIG. 1 is a diagram schematically illustrating a configuration of a bag supply device.

FIG. 1 is a diagram showing an outline of the configuration of the bag supply apparatus 100. The bag supply apparatus 100 includes a transfer mechanism 10, a placement unit 105, and a receiving device 110.

The placement unit 105 arranges and holds one or more bags B (in the example illustrated in FIG. 1, a plurality of bags B) at the pickup position P1. The configuration of the placement unit 105 is not limited, and typically the placement unit 105 can be constituted by a magazine that houses a large number of stacked bags B. In a case where the placement unit 105 holds a plurality of bags B, the placement unit 105 has a mechanism which arranges a bag being a next pickup candidate of the plurality of bags B, at a predetermined position (that is, at the pickup position P1). For example, if a plurality of bags B are stacked in a direction parallel to the vertical direction in the placement unit 105, the placement unit 105 has a mechanism which always positions an uppermost bag B at substantially the same position (that is, same height position). Alternatively, if a plurality of bags B are stacked in the horizontal direction in the placement unit 105, the placement unit 105 has a mechanism which always positions a bag B exposed to the transfer mechanism 10 (normally, a bag B disposed at one end), at the same position (that is, same horizontal position). The placement unit 105 may hold only one bag B. In such a case, the placement unit 105 may be constituted by a holding body having a placement surface on which the one bag B is placed, and a mechanism which arranges the bag B, which is to be taken out, on the placement surface may be used.

The receiving device 110 is provided at a position corresponding to the delivery position P2, and receives a bag B arranged at the delivery position P2 from the transfer mechanism 10. The configuration of the receiving device 110 is not limited, and the illustrated receiving device 110 has a gripper 111, and a bag B arranged at the delivery position P2 is gripped by this gripper 111. A bag B gripped by the gripper 111 is sent to the subsequent stage.

The transfer mechanism 10 picks up a bag B from the placement unit 105, transfers the bag B from the pickup position P1 to the delivery position P2, and delivers the bag B to the receiving device 110. In particular, the transfer mechanism 10 of the present embodiment substantially stops the movement of a holding unit 52 when a bag B is picked up from the placement unit 105 and when a bag B is delivered to the receiving device 110. As a result, it is possible to accurately pick up and deliver a bag B.

[Transfer Mechanism]

Next, a specific configuration example of the transfer mechanism 10 will be described.

Figure 2:
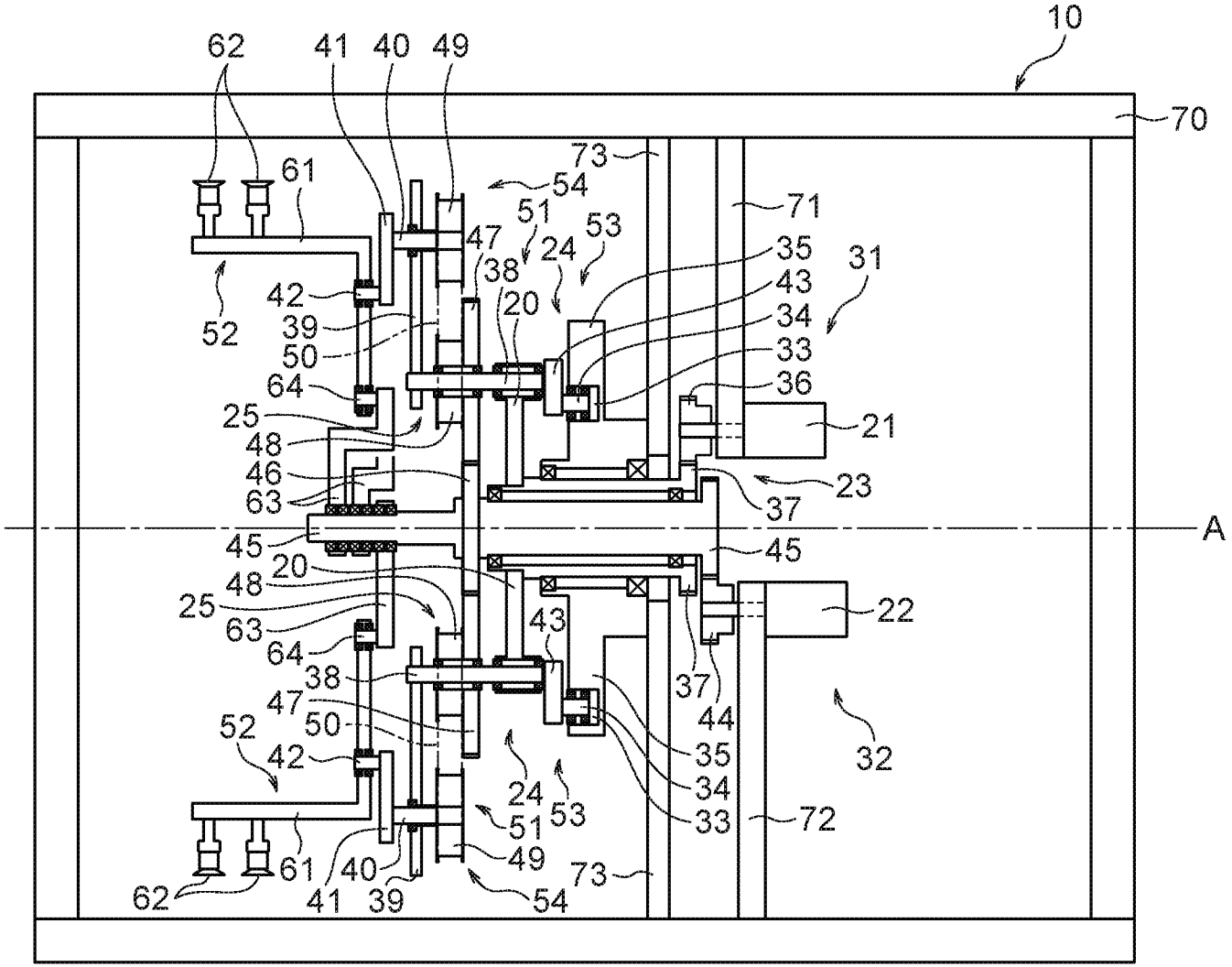
FIG. 2 is a diagram illustrating a transfer mechanism viewed from the side in which a cross-section surface is partially shown.
Figure 3:
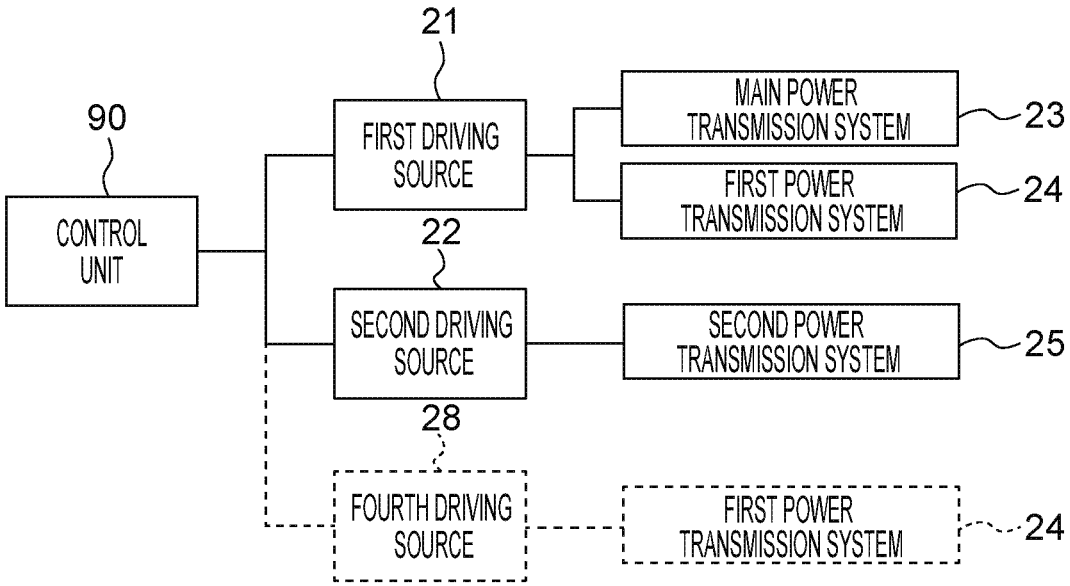
FIG. 3 is a functional block diagram of a control unit.

FIG. 2 is a diagram illustrating a transfer mechanism 10 viewed from the side in which a cross-section surface is partially shown. FIG. 3 is a functional block diagram of a control unit 90. In FIG. 2, the members indicated by the "X" marks (i.e., cross marks) are bearings, and members which are adjacent to each other via a bearing can rotate basically without affecting each other.

The transfer mechanism 10 includes a main rotating member 20, a first driving unit 31, support mechanisms 51, holding units 52, a second driving unit 32, and the control unit 90.

The main rotating member 20 is fixedly attached to a first rotating body 37 and rotates together with the first rotating body 37 in a first rotation direction Dt1 around the rotational axis A. As the main rotating member 20 rotates, the holding units 52 connected to the main rotating member 20 also rotate in the first rotation direction Dt1 around the rotational axis A, and sequentially and repeatedly travel the pickup position P1, the delivery position P2 and the standby position P3, which are shown in FIG. 1. The pickup position P1 is a position where a bag B which is to be picked up from the placement unit 105 by the transfer mechanism 10 is located, the delivery position P2 is a position where a bag B which is to be delivered from the transfer mechanism 10 to the receiving device 110 is located, and the standby position P3 is a position where suction members 62 stand by. In the present embodiment, as will be described later, the main rotating member 20 rotates at a constant speed around the rotational axis A, but the holding units 52 do not rotate at a constant speed around the rotational axis A.

Although the specific shape of the main rotating member 20 is not limited, the main rotating member 20 has a shape that is capable of holding third supporting shafts 38 (fourth connection bodies) provided as many as the holding units 52. In the illustrated example, three holding units 52 are provided, and the main rotating member 20 holds three third supporting shafts 38. In particular, the illustrated main rotating member 20 includes three lever-shaped bodies extending from the first rotating body 37 in outward directions perpendicular to the rotational axis A. These three lever-shaped bodies are arranged at equal angular intervals around the rotational axis A, and the three third supporting shafts 38 are held by the lever-shaped bodies respectively.

The main rotating member 20 holds the third supporting shafts 38 in such a manner that the third supporting shafts 38 are rotatable with reference to the center axes of the third supporting shafts 38 extending parallel to the rotational axis A, and rotates each of the third supporting shafts 38 around the rotational axis A along with the rotation of the main rotating member 20 around the rotational axis A.

Each of the third supporting shafts 38 extends parallel to the rotational axis A, and one end (the right end in FIG. 2) of each third supporting shaft 38 is fixed to a third lever 43, and the other end (the left end in FIG. 2) of each third supporting shaft 38 is fixed to a fourth lever 39 (third connection body). Accordingly, the other side of each fourth lever 39 is fixedly supported by a third supporting shaft 38. Each third supporting shaft 38 rotates around the axis according to the swing of the third lever 43, and the fourth lever 39 swings according to the axial rotation of the third supporting shaft 38. Each fourth lever 39 extends in a direction perpendicular to the rotational axis A, the third supporting shaft 38 is fixed to one side of the fourth lever 39, and a second rotating shaft 40 is fixed to the other side of the fourth lever 39 in such a manner that the second rotating shaft 40 is rotatable around the axis. Since the second rotating shaft 40 is fixed to the other end of a second lever 41 (second connection body), one side of the fourth lever 39 is connected to the other side of the second lever 41 in such a manner that the fourth lever 39 is rotatable with respect to the other side of the second lever 41. Each second rotating shaft 40 is movably provided, but each third supporting shaft 38 is constrained by the main rotating member 20 and is arranged at a position according to the rotational position of the main rotating member 20. Specifically, one side of each third supporting shaft 38 is rotatably supported by the main rotating member 20, and each third supporting shaft 38 rotates around the rotational axis A together with the main rotating member 20. Accordingly, each fourth lever 39 swings with reference to the third supporting shaft 38 according to the axial rotation of the third supporting shaft 38.

Each third lever 43 extends in a direction perpendicular to the rotational axis A, a cam body 34 is fixed to one end portion (lower end portion in FIG. 2) of each third lever 43, and the third supporting shaft 38 is fixed to the other end portion (upper end portion in FIG. 2) of each third lever 43. Each third lever 43 assumes a swinging posture according to the respective positions of the cam body 34 and the third supporting shaft 38.

The first driving unit 31 rotates the main rotating member 20 around the rotational axis A in the first rotation direction Dt1. The first driving unit 31 illustrated in FIG. 2 includes a first driving source 21, a first gear 36 and the first rotating body 37. The first driving source 21 is attached to a support plate 71 fixed to a frame 70, and rotates its output shaft around the axis under the control of the control unit 90 to output rotative power. The first driving source 21 is not limited, but is typically constituted by a servomotor. The first gear 36 is fixedly mounted on the output shaft of the first driving source 21, and rotates about this output shaft in accordance with the axial rotation of the output shaft. The first rotating body 37 has a hollow tube shape extending parallel to the rotational axis A, and the central axis of the first rotating body 37 coincides with the rotational axis A. The first rotating body 37 meshes with the first gear 36 and rotates about the rotational axis A in accordance with the rotation of the first gear 36.

A second rotating body 45 is arranged inside the first rotating body 37 via bearings, and a guide member 35 is arranged outside of the first rotating body 37 via bearings. In this manner, the first rotating body 37 is rotatably supported by the second rotating body 45 and the guide member 35 via the bearings, and is able to rotate around the rotational axis A regardless of the rotating state and the fixed state of the second rotating body 45 and the guide member 35. Likewise, the second rotating body 45 is able to rotate around the rotational axis A regardless of the rotating state and the fixed state of the first rotating body 37 and the guide member 35. Further, the guide member 35 is supported by a support plate 73 in a fixed manner regardless of the rotating state and the fixed state of the second rotating body 45 and the first rotating body 37. A through hole is formed in the support plate 73 fixed to the frame 70, and the first rotating body 37 and the second rotating body 45 are arranged so as to penetrate this through hole.

The second driving unit 32 drives the support mechanisms 51. The illustrated second driving unit 32 includes a second driving source 22, a second gear 44, the second rotating body 45 and a third gear 46. The second driving source 22 rotates its output shaft around the axis under the control of the control unit 90 to output rotative power. The second driving source 22 is not limited, but typically is constituted by a servomotor. The second gear 44 is fixedly mounted on the output shaft of the second driving source 22, and rotates around the axis with reference to this output shaft, together with this output shaft. The second rotating body 45 has the central axis which coincides with the rotational axis A, meshes with the second gear 44, and rotates about the rotational axis A according to the rotation of the second gear 44.

In the illustrated transfer mechanism 10, the power output from the first driving source 21 is used to rotate the main rotating member 20 and also to drive a part of a support mechanism 51 (in particular, the first regulating mechanisms 53 described later). Therefore, in terms of function, the first driving source 21 is included in both of the first driving unit 31 and the second driving unit 32. On the other hand, the second driving source 22 is attached to a support plate 72 fixed to the frame 70, is mainly used for driving the support mechanisms 51 (in particular, the second regulating mechanisms 54 described later), and is therefore included in the second driving unit 32 from the functional viewpoint.

The support mechanisms 51 are driven by the second driving unit 32 and are driven according to the arrangement positions of the cam bodies 34 in a cam groove 33. Specifically, the support mechanisms 51 are connected to the main rotating member 20 and are connected to the holding units 52, and adjust the relative positions of the holding units 52 with respect to the main rotating member 20. The concept of "positions" used here also includes the concept of "postures". In the illustrated transfer mechanism 10, a plurality of support mechanisms 51 (specifically, three support mechanisms 51) are provided, and a plurality of holding units 52 (specifically, three holding units 52) are connected to the three support mechanisms 51 respectively. The three support mechanisms 51 are connected to the main rotating member 20 at equal angular intervals with respect to the rotation direction Dt about the rotational axis A. Further, the three holding units 52 are also connected to the main rotating member 20 via the three support mechanisms 51 so as to be disposed at equal angular intervals with respect to the rotation direction Dt.

The holding units 52 are connected to the support mechanisms 51 and each have a configuration capable of holding a bag B. The illustrated holding units 52 each include a mounting plate 61 and suction members 62.

One side of each mounting plate 61 is rotatably connected to a first lever 63 (first connection body) via a first support shaft 64, and the other side of each mounting plate 61 is rotatably connected to a second lever 41 via a second support shaft 42 and also supports suction members (a holding unit 52) in a fixed manner. Each first support shaft 64 is supported by a mounting plate 61 so as to be rotatable about the central axis of the first support shaft 64 extending parallel to the rotational axis A. The central axis of each second support shaft 42 extends parallel to the rotational axis A, and each second support shaft 42 is supported by a mounting plate 61 so as to be rotatable about its central axis. The mounting plates 61 and the suction members 62 assume swing postures according to the positions of the first support shafts 64 and the second support shafts 42, and the positions of the mounting plates 61 and the suction members 62 are determined according to the positions of the first support shafts 64 and the second support shafts 42.

A first lever 63 is provided for each holding unit 52, and in the illustrated transfer mechanism 10, three first levers 63 are provided. Each of the first levers 63 extends in a direction perpendicular to the rotational axis A, the end portion on one side of each first lever 63 is rotatably connected to one side of a mounting plate 61 via a first support shaft 64, and the end portion on the other side of each first lever 63 is provided rotatable about the rotational axis A and particularly is supported by the second rotating body 45 so as to be rotatable about the rotational axis A. Accordingly, each first lever 63 is provided so as to be swingable around the rotational axis A, and assumes a swing posture according to the positions of the first support shaft 64 and the second rotating body 45.

The suction surface of each suction member 62 is oriented in a direction away from the rotational axis A, of the directions perpendicular to the rotational axis A. The illustrated suction members 62 are constituted by suction cups and are configured so as to be able to suck and hold the surface of a bag B.

Each support mechanism 51 has a first regulating mechanism 53 and a second regulating mechanism 54. The first regulating mechanisms 53 can at least partly cancel out the force transmitted from the main rotating member 20 to the support mechanisms 51, for a temporary period time, with respect to a first regulating direction Dr1. The second regulating mechanisms 54 can at least partly cancel out the force transmitted from the main rotating member 20 to the support mechanisms 51, for a temporary period time, with respect to a second regulating direction Dr2, which is a direction different from the first regulating direction Dr1. As a result, the speeds of the mounting plates 61 and the suction members 62 can be canceled out, and it is possible to stop the suction members 62.

Figure 4:
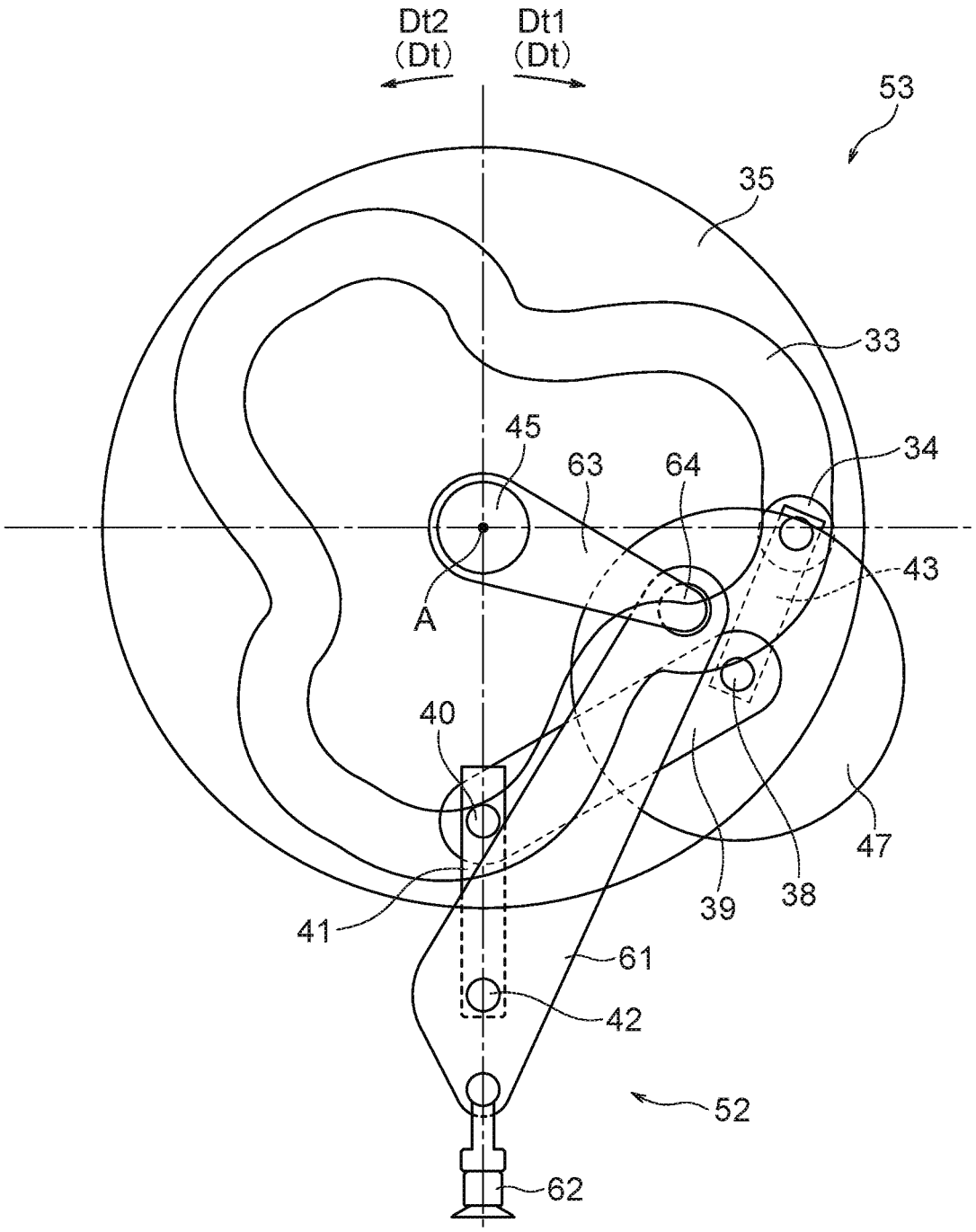
FIG. 4 is a diagram illustrating a configuration of a first regulating mechanism.

FIG. 4 is a view illustrating the configuration of a first regulating mechanism 53.

The first regulating mechanism 53 illustrated in FIGS. 2 and 4 includes: the guide member 35 having the cam groove 33; and a cam body 34 connected to the main rotating member 20 (see FIG. 2) via a third lever 43 and a third supporting shaft 38. The guide member 35 is fixedly attached to the support plate 73. Each cam body 34 is movably disposed in the cam groove 33. The distance of the cam groove 33 from the rotational axis A in a direction perpendicular to the rotational axis A changes with respect to the rotation direction Dt. The cam body 34 is fixed to the third lever 43. Since the third lever 43 is connected to the main rotating member 20 via the third supporting shaft 38 as described above, when the main rotating member 20 rotates around the rotational axis A, the cam body 34 moves in the first rotation direction Dt1 while being guided along the cam groove 33. On the other hand, the distance of the cam groove 33 from the rotational axis A is variably defined according to the angular position with reference to the rotational axis A. Accordingly, the distance of the cam body 34 from the rotational axis A is not constant with respect to the rotation direction Dt, but changes similarly to the cam groove 33. In this manner, the position of the cam body 34 in the plane perpendicular to the rotational axis A (specifically, the distance from the rotational axis A and the angular position with reference to the rotational axis A) is determined according to the rotation position of the main rotation member 20. The speeds in the first regulating direction Dr1 of the mounting plates 61 and the suction members 62 are canceled out according to the arrangement positions of the cam bodies 34 in the cam groove 33.

Specifically, each third lever 43 swings with reference to the third supporting shaft 38 according to the position of the cam body 34 in the cam groove 33. The third supporting shaft 38 rotates with reference to the central axis thereof according to this swinging of the third lever 43, and the fourth lever 39 swings with reference to the third supporting shaft 38 according to this axial rotation of the third supporting shaft 38. The second rotating shaft 40 swings with reference to the third supporting shaft 38 according to this swinging of the fourth lever 39, and the second lever 41 swings with reference to the second support shaft 42 according to this swinging of the second rotating shaft 40. The second support shaft 42 performs an axial rotation or moves with reference to its central axis according to this swinging of the second lever 41. One side of the second lever 41 is rotatably connected to the other side of the mounting plate 61, and the other side of the second lever 41 is fixedly connected to the second rotating shaft 40.

When each first regulating mechanism 53 operates as described above, the speeds of the mounting plate 61 and the suction members 62 in the first rotation direction Dt1 are canceled out, and the position of the holding unit 52 with respect to the first regulating direction Dr1 is adjusted.

Figure 5:
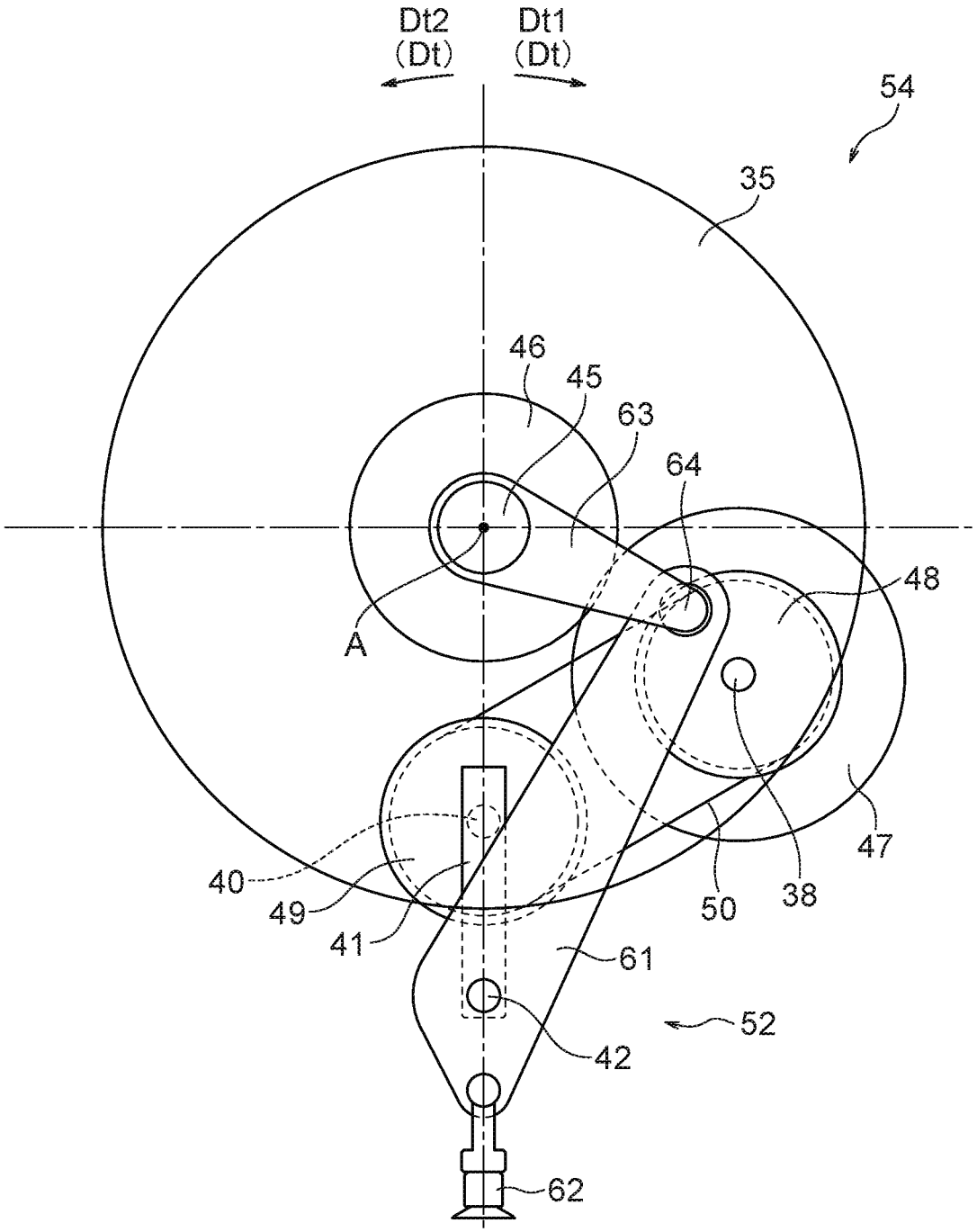
FIG. 5 is a diagram illustrating a configuration of a second regulating mechanism.

FIG. 5 is a view illustrating the configuration of a second regulating mechanism 54. The second regulating mechanism 54 illustrated in FIGS. 2 and 5 includes, for example, a fourth gear 47, a first pulley 48, a second pulley 49, a second rotating shaft 40, a second lever 41 and a second support shaft 42.

The third gear 46 is fixedly attached to the second rotating body 45, the central axis of the third gear 46 coincides with the rotational axis A, and the third gear 46 rotates around the axis integrally with the second rotating body 45. The fourth gear 47 meshes with the third gear 46. The central axis of the fourth gear 47 is parallel to the rotational axis A and coincides with the central axis of the third supporting shaft 38, and the fourth gear 47 rotates about its central axis. The fourth gear 47 is supported by the third supporting shaft 38 so as to be rotatable around the axis. The first pulley 48 is fixedly attached to the fourth gear 47, the first pulley 48 and the fourth gear 47 are coaxially arranged, the central axis of the fourth gear 47 coincides with the central axis of the first pulley 48, and the first pulley 48 rotates around its axis integrally with the fourth gear 47. The second pulley 49 is connected to the first pulley 48 by means of an endless belt 50. The central axis of the second pulley 49 extends in parallel with the rotational axis A, and the second pulley 49 performs axial rotation with reference to its central axis according to the axial rotation of the first pulley 48.

One end portion of the second rotating shaft 40 extending in a direction parallel to the rotational axis A is fixedly attached to the second pulley 49. The central axis of the second rotating shaft 40 coincides with the central axis of the second pulley 49, and the second rotating shaft 40 rotates around its axis integrally with the second pulley 49. The other end portion of the second rotating shaft 40 is fixedly attached to one end portion of the second lever 41 extending in a direction perpendicular to the rotational axis A. On the other hand, the second support shaft 42 is fixedly attached to the other end portion of the second lever 41. Accordingly, the second lever 41 assumes a swinging posture according to the positions of the second rotating shaft 40 and the second support shaft 42. The second support shaft 42 is rotatable with reference to its central axis according to the swinging state of the second lever 41.

Figure 6:
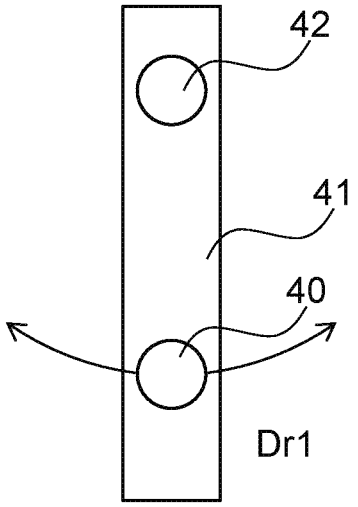
FIG. 6 is a schematic view of a second rotating shaft, a second lever, and a second support shaft, and is a diagram for explaining regulation performed by the first regulating mechanism.
Figure 7:
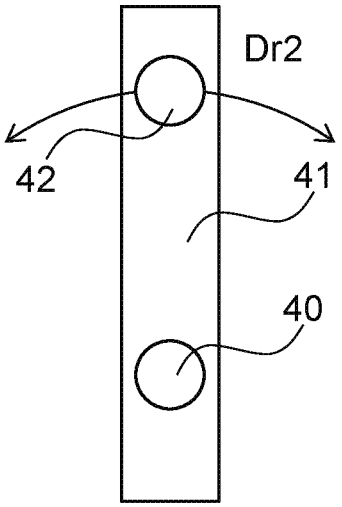
FIG. 7 is a schematic view of the second rotating shaft, the second lever, and the second support shaft, and is a diagram for explaining regulation performed by the second regulating mechanism.

FIG. 6 is a schematic view of a second rotating shaft 40, a second lever 41 and a second support shaft 42, and is a diagram for explaining the regulation performed by a first regulating mechanism 53. FIG. 7 is a schematic view of a second rotating shaft 40, a second lever 41 and a second support shaft 42, and is a diagram for explaining regulation performed by a second regulating mechanism 54.

Each first regulating mechanism 53 regulates the position of a holding unit 52 according to the arrangement of a cam body 34 in the cam groove 33 as described above. More specifically, the position of the third lever 43 is determined according to the arrangement of the cam body 34 in the cam groove 33, the third supporting shaft 38 performs axial rotation according to the position of the third lever 43, the fourth lever 39 swings with reference to the third supporting shaft 38 according to the axial rotation of the third supporting shaft 38, and the second rotating shaft 40 swings with reference to the third supporting shaft 38 according to the swinging of the fourth lever 39. As a result, as illustrated in FIG. 6, the second lever 41 swings in the first regulating direction Dr1 with reference to the second support shaft 42 according to the swinging of the second rotating shaft 40. The position of the holding unit 52 is regulated according to the arrangement of the second support shaft 42 determined based on this swinging of the second lever 41.

On the other hand, each second regulating mechanism 54 regulates the position of a holding unit 52 according to the power from the second driving source 22. Specifically, the second gear 44, the second rotating body 45, the third gear 46, the fourth gears 47, the first pulleys 48 and the second pulleys 49 are rotated according to the rotative power output from the second driving source 22, and the second rotating shafts 40 rotate around their axes together with the second pulleys 49. As a result, as illustrated in FIG. 7, the second lever 41 fixed to the second rotating shaft 40 swings in the second regulating direction Dr2 with reference to the second rotating shaft 40 according to the axial rotation of the second rotating shaft 40. The position of the holding unit 52 is regulated according to the arrangement of the second support shafts 42 determined based on this swinging of the second lever 41.

As described above, the position of each holding unit 52 is regulated according to the result of the combination of the regulating actions of both the first regulating mechanism 53 and the second regulating mechanism 54. Specifically, as the main rotating member 20 rotates in the first rotation direction Dt1, a force causing the turn in the first rotation direction Dt1 is exerted on the support mechanism 51 connected to the holding unit 52 whereas a force causing the turn in the second rotation direction Dt2 (i.e., the rotation direction opposite to the first rotation direction Dt1) is exerted on the support mechanism 51 connected to the holding unit 52 based on the combination of regulating actions of the first regulating mechanism 53 and the second regulating mechanism 54. Accordingly, the speeds of the mounting plate 61 and the suction members 62 are canceled out by the support mechanism 51. As a result, in each of the pickup position P1, the delivery position P2 and the standby position P3, the force in the first rotation direction Dt1 does not or hardly act on the holding unit 52 for a temporary period of time, so that the movement of the holding unit 52 can be stopped or suppressed.

In order to realize such behavior of the holding units 52, the control unit 90 controls the second driving source 22 according to the rotational state of the main rotating member 20 in the first rotation direction Dt1 (that is, the operating condition of the first driving source 21) in such a manner that the movement of the holding units 52 is stopped or suppressed according to the timings at which the suction members 62 are arranged at the positions corresponding to the pickup position P1, the delivery position P2 and the standby position P3.

Specifically, the control unit 90 controls at least the second driving unit 32 (at least the second driving source 22) of the first driving unit 31 and the second driving unit 32. The control unit 90 of the present embodiment controls both the first driving unit 31 and the second driving unit 32, and specifically, controls the first driving source 21 and the second driving source 22. However, the control unit 90 may control only the second driving unit 32 without controlling the first driving unit 31, and may control only the second driving source 22 for example. In such a case, the first driving unit 31 (in particular, the first driving source 21) may be driven and controlled by another device.

In a case where a bag B is arranged in at least one of the pickup position P1 and the delivery position P2 (in this embodiment, in each of the pickup position P1 and the delivery position P2), the control unit 90 performs control to cause the support mechanisms 51 to operate so as to cancel out the speeds of the mounting plates 61 and the suction members 62 based on the force transmitted from the main rotating member 20 to the support mechanisms 51, in a state where the main rotating member 20 is rotating around the rotational axis A in the first rotation direction Dt1. Specifically, by causing the support mechanisms 51 to generate a force acting in the first adjustment direction Da1 including a component of the second rotation direction Dt2, the speeds of the mounting plates 61 and the suction members 62 based on the force transmitted from the main rotation member 20 to the support mechanisms 51 are cancelled out, and the force in the first adjustment direction Da1 transmitted from the support mechanisms 51 to the holding units 52 is reduced. The first adjustment direction Da1 is a direction determined based on the above-described regulation with respect to the first regulating direction Dr1 and the second regulating direction Dr2. Accordingly, the above-described first regulating direction Dr1 and second regulating direction Dr2 are also included in the direction components constituting the second rotation direction Dt2. In order to completely stop the holding units 52, it is required that the first adjustment direction Da1 coincides with the second rotation direction Dt2; however, it is not necessarily required to strictly and completely stop the holding units 52 and the first adjustment direction Da1 may be deviated from the second rotation direction Dt2.

As described above, the control unit 90 controls at least the second driving unit 32 (at least the second driving source 22) of the first driving unit 31 and the second driving unit 32 in such a manner that, when a bag B is located in at least one of the pickup position P1 and the delivery position P2, the first regulating mechanisms 53 and the second regulating mechanisms 54 are caused to operate in a state where the main rotating member 20 is rotating around the rotational axis A in the first rotation direction Dt1. As a result, the positions of the holding units 52 can be substantially unchanged.

For example, the control unit 90 performs control in such a manner that, when a bag B is placed in the delivery position P2, the position of a holding unit 52 does not substantially change at least while the bag B is delivered from the holding unit 52 to the receiving device 110. Further, the control unit 90 performs control in such a manner that, when a holding unit 52 holds a bag B placed in the pickup position P1, the position of the holding unit 52 does not substantially change for a temporary period of time. A holding unit 52 being in a state where its position does not substantially change is not necessarily required to be strictly completely stopped, and for example, the position of the holding unit 52 may change very slightly (for example, by approximately several mm (millimeters) to several cm (centimeters)).

The control unit 90 may perform control in such a manner that, when a bag B is placed in the delivery position P2, the position of a holding unit 52 changes in a desired state at least while the bag B is transferred from the holding unit 52 to the receiving device 11. Further, the control unit 90 may perform control in such a manner that, when a holding unit 52 holds a bag B arranged at the pickup position P1, the position of the holding unit 52 changes in a desired state. Even in these cases, the control unit 90 preferably performs control in such a manner that it is suitably carried out to deliver a bag B to the receiving device 110 and to take out a bag B from the placement unit 105 and the degree of change in the positions of the holding units 52 is suppressed.

As described above, the transfer mechanism 10 includes the first driving source 21 and the second driving source 22 each of which outputs power. The first driving unit 31 includes a main power transmission system 23 (for example, the first gear 36 and the first rotating body 37), and the power output from the first driving source 21 is transmitted to the main rotating member 20 by means of the main power transmission system 23, so as to rotate the main rotating member 20 in the first rotation direction Dt1. On the other hand, the second driving unit 32 includes: a first power transmission system 24 (for example, the first gear 36, the first rotating body 37, the main rotating member 20 and the third levers 43) which transmits the power output from the first driving source 21 to the first regulating mechanisms 53; and a second power transmission system 25 (for example, the second gear 44, the second rotating body 45 and the third gear 46) which transmits the power output from the second driving source 22 to the second regulating mechanisms 54. Accordingly, the first regulating mechanisms 53 are driven based on the power output from the first driving source 21, and the second regulating mechanisms 54 are driven based on the power output from the second driving source 22.

[Behavior of Holding Units]

Next, the overall behavior of the holding units 52 will be described.

Figure 8A:
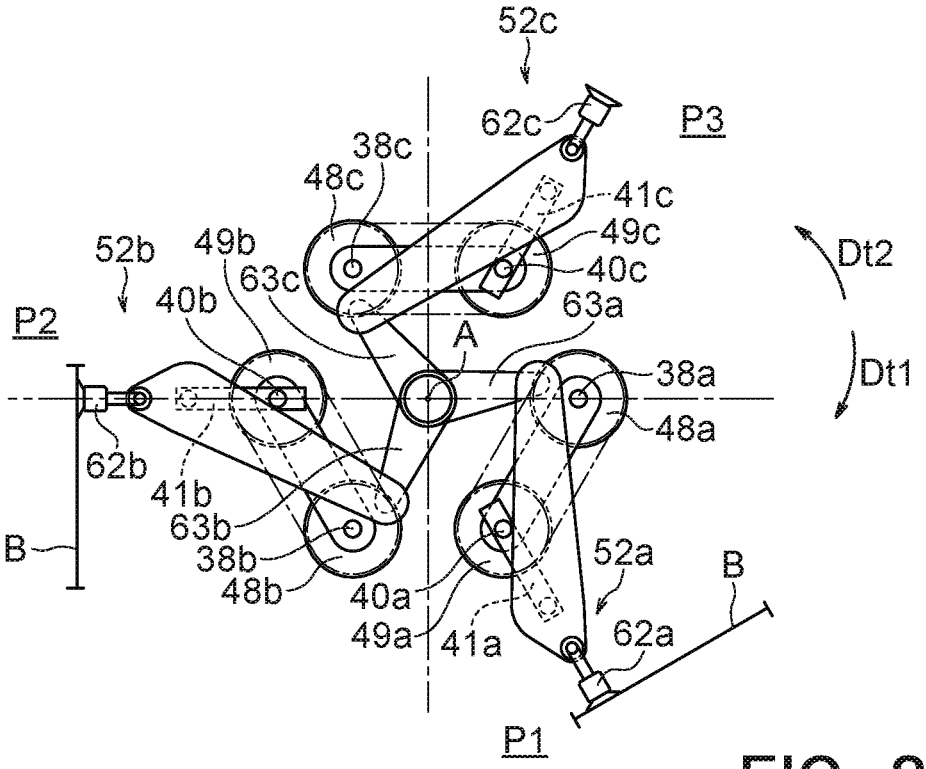
FIG. 8A is a view illustrating an operating state of the transfer mechanism (the rotational angular position of a main rotating member=0 degrees).
Figure 8B:
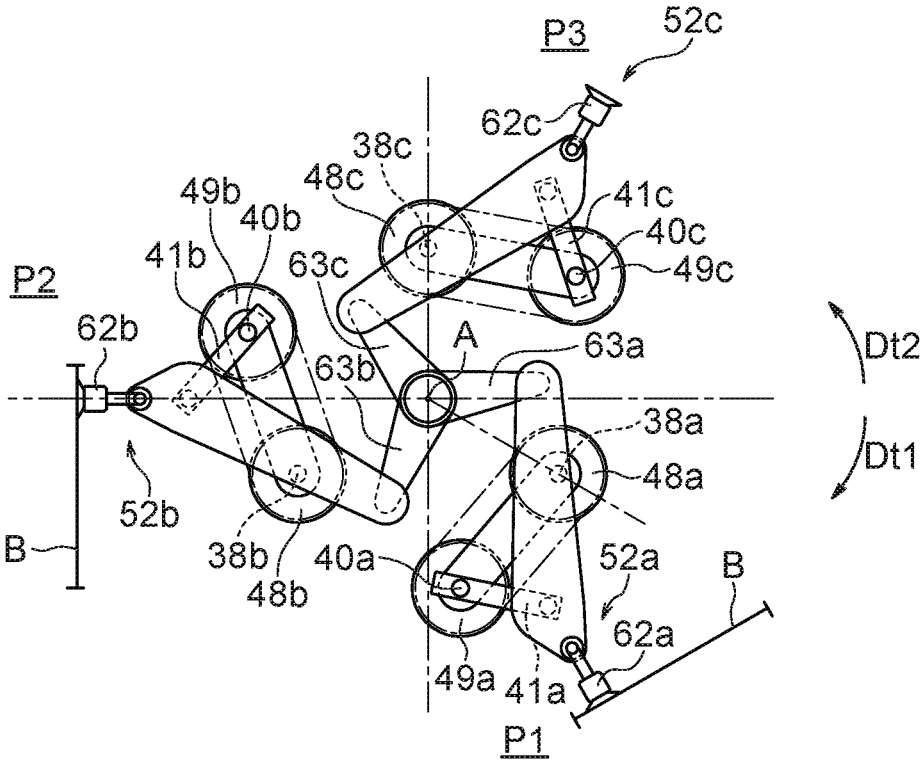
FIG. 8B is a view illustrating an operating state of the transfer mechanism (the rotational angular position of the main rotating member=30 degrees).
Figure 8C:
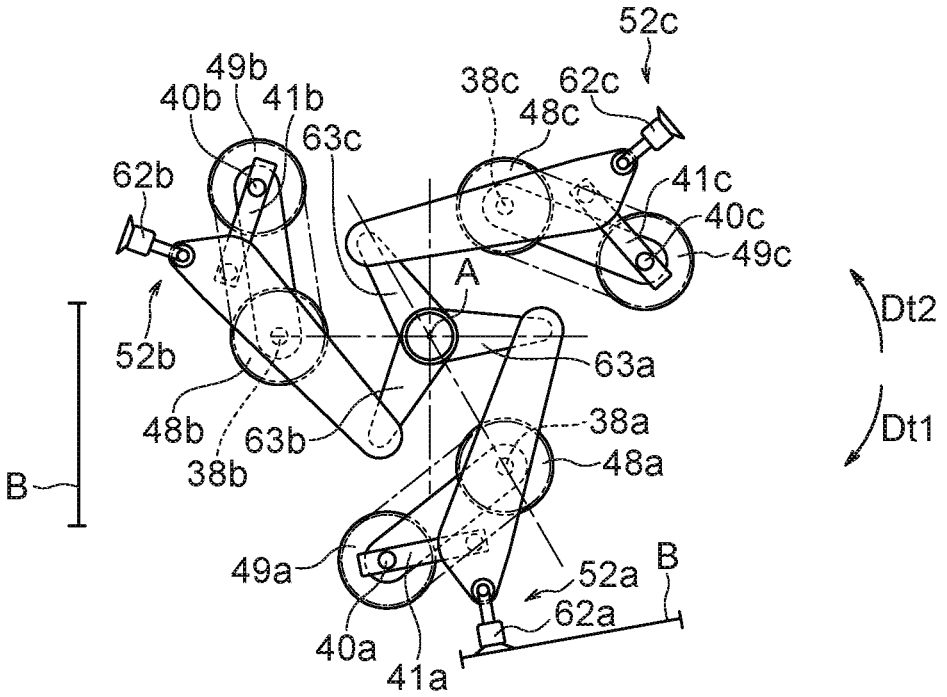
FIG. 8C is a view illustrating an operating state of the transfer mechanism (the rotational angular position of the main rotating member=60 degrees).
Figure 8D:
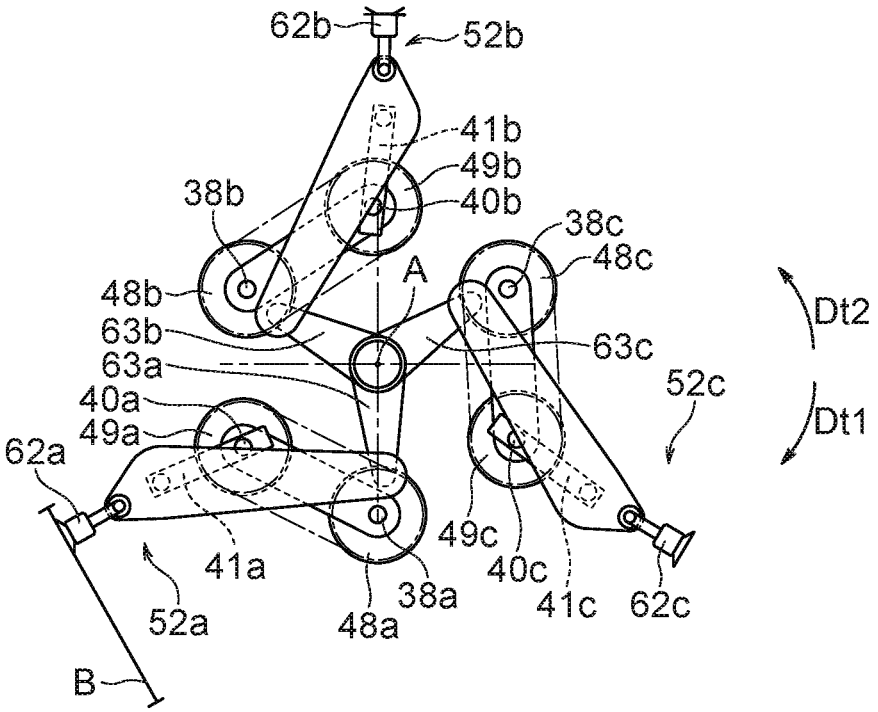
FIG. 8D is a view illustrating an operating state of the transfer mechanism (the rotational angular position of the main rotating member=90 degrees).

FIGS. 8A to 8D are diagrams illustrating operating states of the transfer mechanism 10. Specifically, the rotation states of the holding units 52, in states where the main rotating member 20 rotates around the rotational axis A in the first rotation direction Dt1 by 30 degrees, are illustrated in FIGS. 8A to 8D. Therefore, FIG. 8B shows the rotation state of the holding units 52 when the main rotating member 20 has rotated in the first rotation direction Dt1 by 30 degrees from the rotational angular position (0 degrees) of the main rotating member 20 being in the state shown in FIG. 8A. Similarly, FIGS. 8C and 8D show the rotation states of the holding units 52 when the main rotating member 20 has rotated in the first rotation direction Dt1 by 30 degrees from the rotational angular positions (30 degrees and 60 degrees) of the main rotating member 20 being in the states shown in FIGS. 8B and 8C respectively.

In FIGS. 8A to 8D, for convenience, "a" is attached to the ends of the codes representing elements assigned to a first holding unit 52*a* of the three holding units 52; "b" is attached to the ends of the codes representing elements assigned to a second holding unit 52*b*; and "c" is attached to the ends of the codes representing elements assigned to a third holding unit 52*c*.

As described above, the third supporting shafts 38 rotate, together with the main rotating member 20, in the first rotation direction Dt1 around the rotational axis A. Accordingly, in FIGS. 8A to 8D, by focusing on the third supporting shafts 38*a* to 38*c*, the rotation state of the main rotating member 20 can be inferred. Specifically, the third supporting shafts 38*a* to 38*c* are arranged in positions where the angular positions with reference to the rotational axis A are shifted by 30 degrees among FIGS. 8A to 8D. Therefore, it can be seen that the main rotating member 20 and the third supporting shafts 38*a* to 38*c* continuously rotates at a constant speed in the first rotation direction Dt1 around the rotational axis A.

On the other hand, the positions of the holding units 52*a* to 52*c* do not substantially change while the main rotating member 20 and the third supporting shafts 38*a* to 38*c* rotate from 0 degrees to 30 degrees in the first rotation direction Dt1 (see FIGS. 8A and 8B), so that the suction members 62*a* to 62*c* stay in the pickup position P1, the delivery position P2 and the standby position P3 respectively. This is because the influence of the movement of the third supporting shafts 38*a* to 38*c* in the first rotation direction Dt1 is canceled out by the movement and swinging of the second pulleys 49*a* to 49*c* and the second levers 41*a* to 41*c*, so that the holding units 52*a* to 52*c* are substantially insulated from the influence. The first driving source 21 and the second driving source 22 drive the support mechanisms 51 (specifically, the first regulating mechanisms 53 and the second regulating mechanisms 54) under the control of the control unit 90 in such a manner that such movement and swinging of the second pulleys 49*a* to 49*c* and the second levers 41*a* to 41*c* are performed.

When the main rotating member 20 further rotates from the state illustrated in FIG. 8B, the holding units 52*a* to 52*c* move with respect to the first rotation direction Dt1 (see FIGS. 8C and 8D). Specifically, the first suction members 62*a* move toward the delivery position P2 while holding a bag B.

Then, the suction members 62*a* to 62*c* are arranged at the pickup position P1, the delivery position P2 and the standby position P3 at the timing when the main rotating member 20 rotates by 120 degrees in the first rotation direction Dt1 around the rotational axis A from the state illustrated in FIG. 8A. In this case, the first suction members 62*a* are arranged at the delivery position P2, the second suction members 62*b* are arranged at the standby position P3, and the third suction members 62*c* are arranged at the pickup position P1. Further, in this case, the second driving source 22 is driven under the control of the control unit 90 in such a manner that the relative positions of the first pulleys 48*a* to 48*c*, the second pulleys 49*a* to 49*c*, and the second levers 41*a* to 41*c* with respect to the holding units 52*a* to 52*c* are also returned to the state as illustrated in FIG. 8A. In the illustrated example, while the main rotating member 20 and the third supporting shafts 38*a* to 38*c* rotate in the first rotation direction Dt1 from the position (see FIG. 8C) which is shifted by 60 degrees in the first rotation direction Dt1 from the position illustrated in FIG. 8A to the position (see FIG. 8D) which is shifted by 90 degrees in the first rotation direction Dt1 from the position illustrated in FIG. 8A, the relative positions of the first pulleys 48*a* to 48*c*, the second pulleys 49*a* to 49*c* and the second levers 41*a* to 41*c* with respect to the holding units 52*a* to 52*c* are returned to the state as illustrated in FIG. 8A.

Then, the above-described operations (see FIGS. 8B to 8D) are repeated. As described above, since the main rotating member 20 and the third supporting shafts 38*a* to 38*c* rotate at a constant speed in the first rotation direction Dt1, the rotative power output from the first driving source 21 is also basically kept constant. On the other hand, the rotative power output from the second driving source 22 is controlled by the control unit 90 according to the rotational positions of the main rotating member 20 and the third supporting shafts 38*a* to 38*c* in such a manner that the relative positions of the first pulleys 48*a* to 48*c*, the second pulleys 49*a* to 49*c* and the second levers 41*a* to 41*c* with respect to the holding units 52*a* to 52*c* are adjusted.

Next, the above-described behavior illustrated in FIGS. 8A and 8B (specifically, the behavior while the main rotating member 20 and the third supporting shafts 38*a* to 38*c* rotate from 0 degrees to 30 degrees) will be described in detail.

Figure 9A:
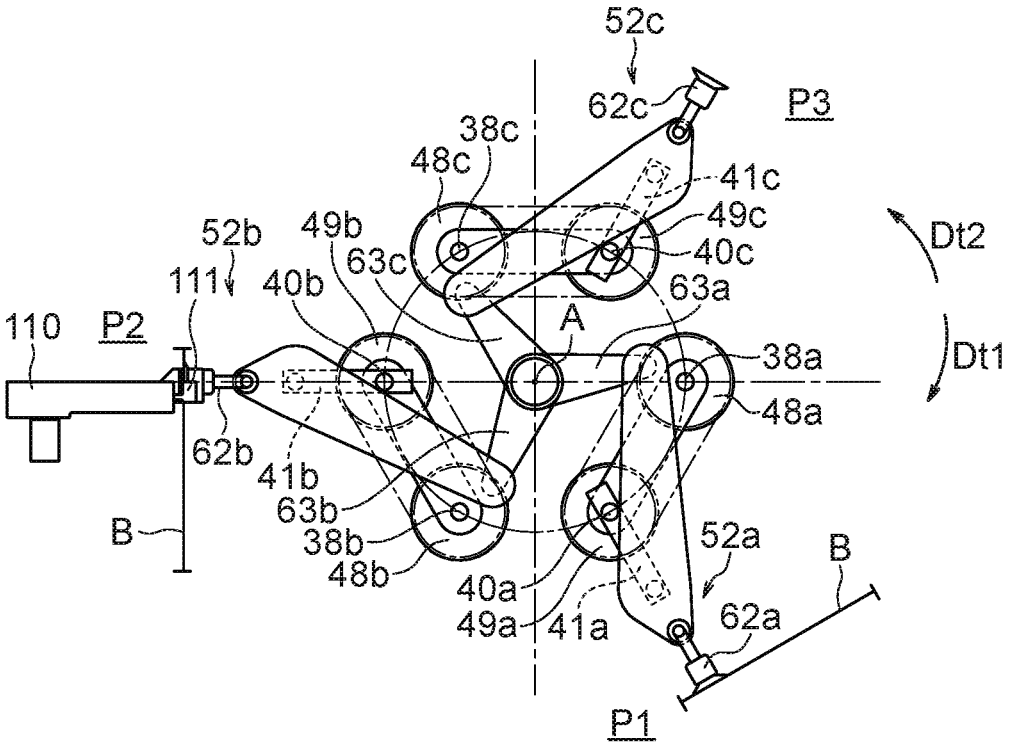
FIG. 9A is a view illustrating an operating state of the transfer mechanism (the rotational angular position of the main rotating member=0 degrees).
Figure 9B:
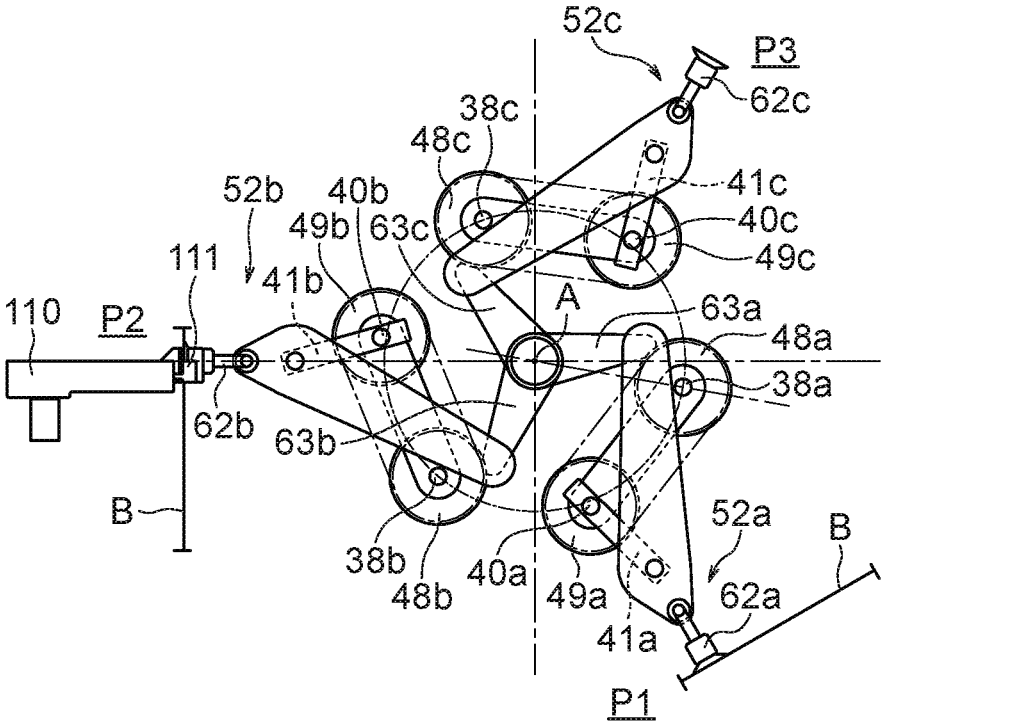
FIG. 9B is a view illustrating an operating state of the transfer mechanism (the rotational angular position of the main rotating member=10 degrees).
Figure 9C:
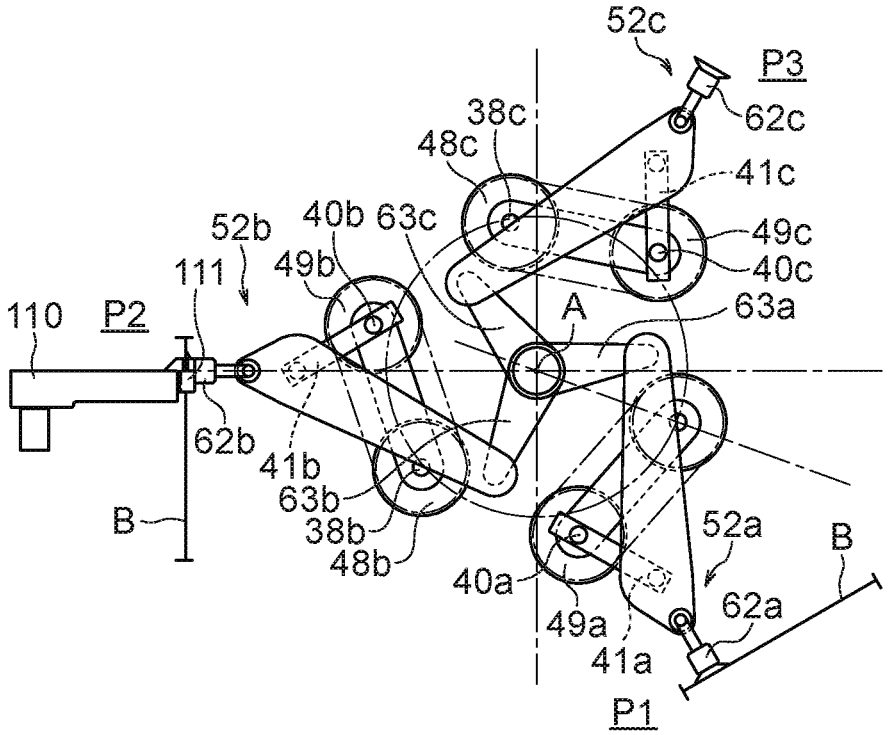
FIG. 9C is a view illustrating an operating state of the transfer mechanism (the rotational angular position of the main rotating member=20 degrees).
Figure 9D:
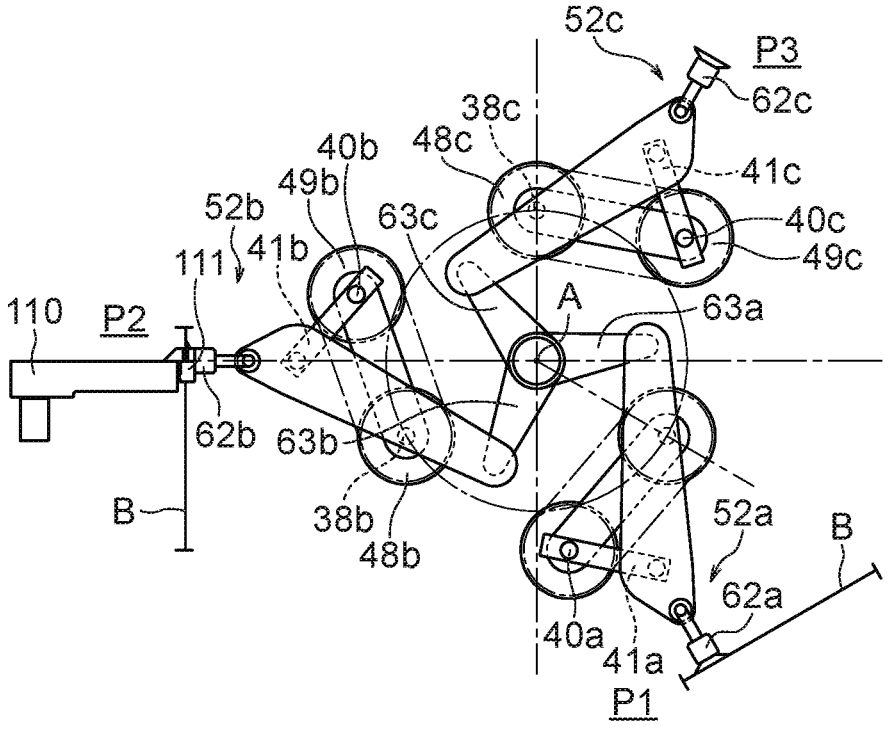
FIG. 9D is a view illustrating an operating state of the transfer mechanism (the rotational angular position of the main rotating member=30 degrees).

FIGS. 9A to 9D are diagrams illustrating operating states of the transfer mechanism 10. Specifically, FIGS. 9A to 9D show rotation states of the holding units 52 when the main rotating member 20 is rotated by 10 degrees around the rotational axis A. FIG. 9B shows the rotation state of the holding units 52 when the main rotating member 20 has rotated by 10 degrees in the first rotation direction Dt1 from the rotational angular position (0 degrees) of the main rotating member 20 being in the state illustrated in FIG. 9A. Likewise, FIGS. 9C and 9D also show the rotation states of the holding units 52 when the main rotating member 20 has rotated by 10 degrees in the first rotation direction Dt1 from the rotational angular positions (10 degrees and 20 degrees) of the main rotating member 20 being in the states illustrated in FIGS. 9B and 9C respectively. Accordingly, the state illustrated in FIG. 9A corresponds to the state illustrated in FIG. 8A described above, and the state illustrated in FIG. 9D corresponds to the state illustrated in FIG. 8B described above.

In FIGS. 9A to 9D, for convenience, "a" is attached to the end of the codes representing elements assigned to the first holding unit 52*a* of the three holding units 52; "b" is attached to the ends of the codes representing elements assigned to the second holding unit 52*b*; and "c" is attached to the ends of the codes representing elements assigned to the third holding unit 52*c*.

As described above, the third supporting shafts 38*a* to 38*c* continuously rotate, together with the main rotating member 20, at a constant speed in the first rotation direction Dt1 around the rotational axis A, and describe a movement trajectory that is equidistant from the rotational axis A (see the circle orbits drawn with one-dot chain lines in FIGS. 9A to 9D).

On the other hand, the positions of the second pulleys 49*a* to 49*c* and the second levers 41*a* to 41*c* with respect to the first pulleys 48*a* to 48*c* are changed according to the movement of the third supporting shafts 38*a* to 38*c* in the first rotation direction Dt1 in such a manner that the holding units 52*a* to 52*c* are stopped and the positions of the holding units 52*a* to 52*c* (that is, the suction members 62*a* to 62*c*) are kept. While the positions of the holding units 52*a* to 52*c* (that is, the suction members 62*a* to 62*c*) are kept in this manner, the suction members 62*a* arranged at the pickup position P1 perform actions to hold a bag B located in the placement unit 105, and the suction members 62*b* arranged at the delivery position P2 performs delivery of a bag B to the receiving device 110.

By substantially stopping the suction members 62*a*, 62*b* at the pickup position P1 and the delivery position P2 for a temporary period of time in this manner, it is possible to improve the accuracy of holding and delivery of bags B. In particular, if a certain amount of time is required for the processing operation on a bag B, such as the gripping actions of the gripper 111, the reliability of such processing operation is dramatically improved by carrying out the processing operation in a state where the suction members 62*a*, 62*b* are substantially stopped. In the example shown in FIGS. 9A to 9D, while the main rotating member 20 and the third supporting shafts 38*a* to 38*c* move from the angular position of 0 degrees to the angular position of 20 degrees (see FIGS. 9A to 9C), the gripper 111 shifts from an open state to a closed state, so that both side portions of a bag B arranged in the delivery position P2 are gripped by the gripper 111.

As described above, according to the transfer mechanism 10 and the bag supply apparatus 100 of the present embodiment, the holding units 52 can be stopped at the pickup position P1 and the delivery position P2 while the main rotating member 20 is rotated at a constant speed. This makes it possible to swiftly transfer a bag B from the pickup position P1 to the delivery position P2 while the movement of bags B can be suppressed when the bags B are arranged in the pickup position P1 and the delivery position P2. In this manner, the transfer mechanism 10 and the bag supply apparatus 100 can pick up and deliver bags B with high accuracy while rapidly and continuously transferring a large number of bags B from the pickup position P1 to the delivery position P2.

Further, by utilizing the cam mechanism using the cam groove 33 and a cam body 34 as a part of a support mechanism 51 (that is, a first regulating mechanism 53) which temporarily stops a holding unit 52, there is no need to separately provide an expensive driving means, such as a servo motor, which needs electrical control. Thus, the configuration of the transfer mechanism 10 (in particular, the support mechanisms 51) can be simplified and the support mechanisms 51 (in particular, the first regulation mechanisms 53) can be realized at low cost.

Further, a plurality of holding units 52 and a plurality of support mechanisms 51 are driven by the common first driving unit 31 and the common second driving unit 32. Accordingly, the transfer mechanism 10 can be easily and conveniently controlled, and the transfer mechanism 10 can be made compact.

First Variant Example

Although the holding units 52 of the above-described embodiment hold bags B by suction, the holding units 52 may hold bags B by other methods. In this variant example, a case where the holding units 52 hold bags B by gripping will be exemplified.

Figure 10:
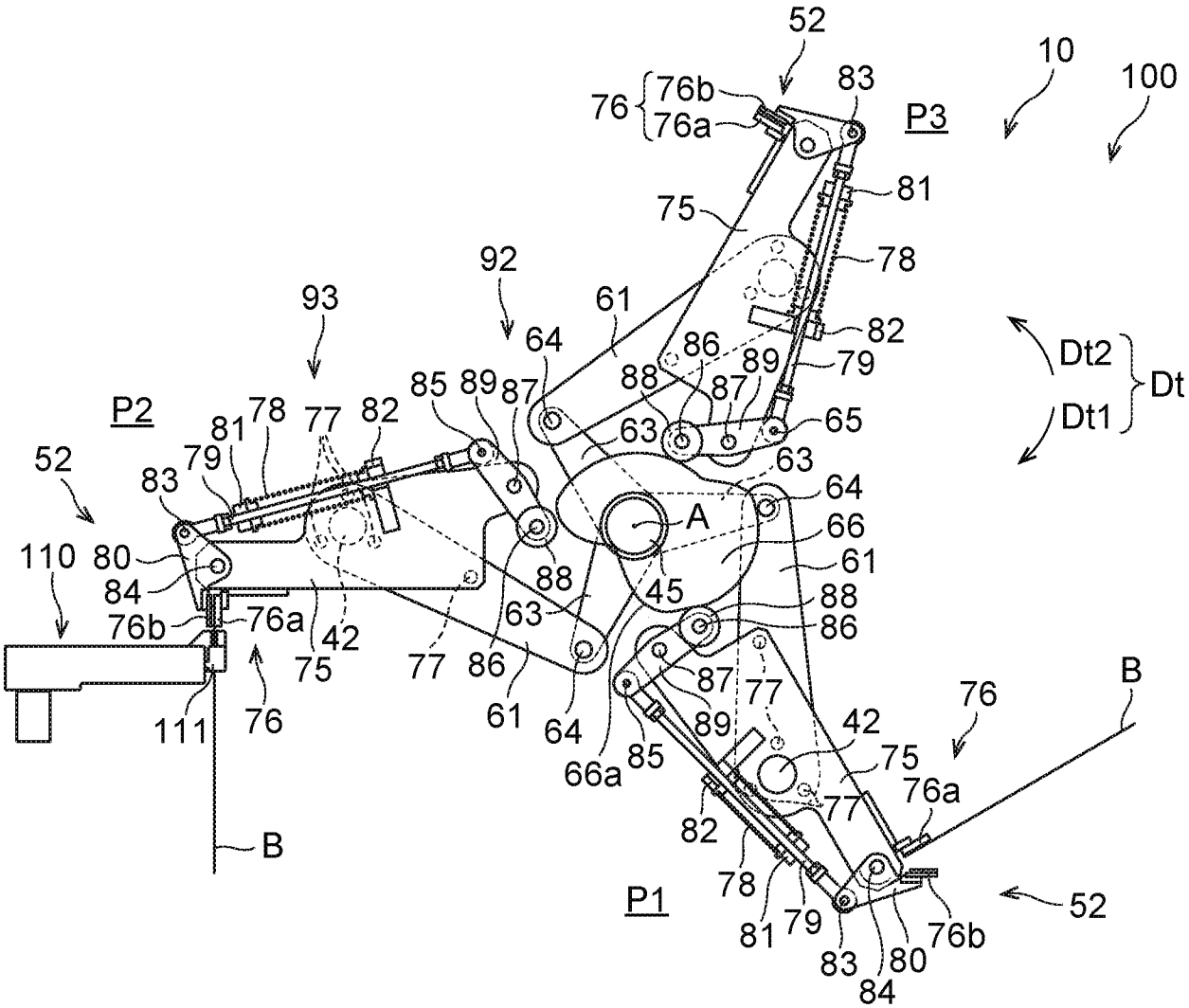
FIG. 10 is a diagram schematically illustrating the configuration of a bag supply device according to a first variant example.
Figure 11:
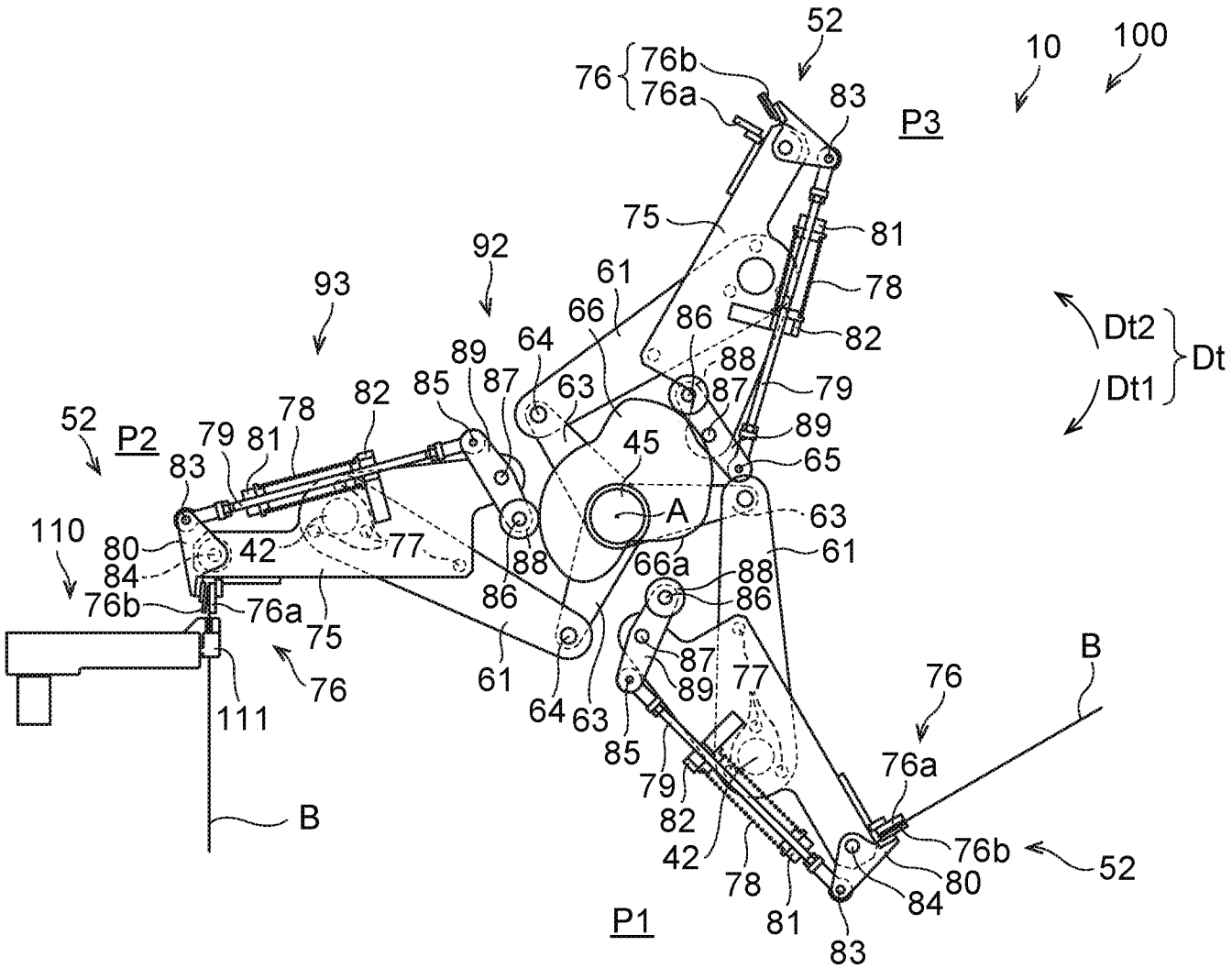
FIG. 11 is a diagram schematically illustrating the configuration of the bag supply apparatus illustrated in FIG. 10, showing a state after the state illustrated in FIG. 10.
Figure 12:
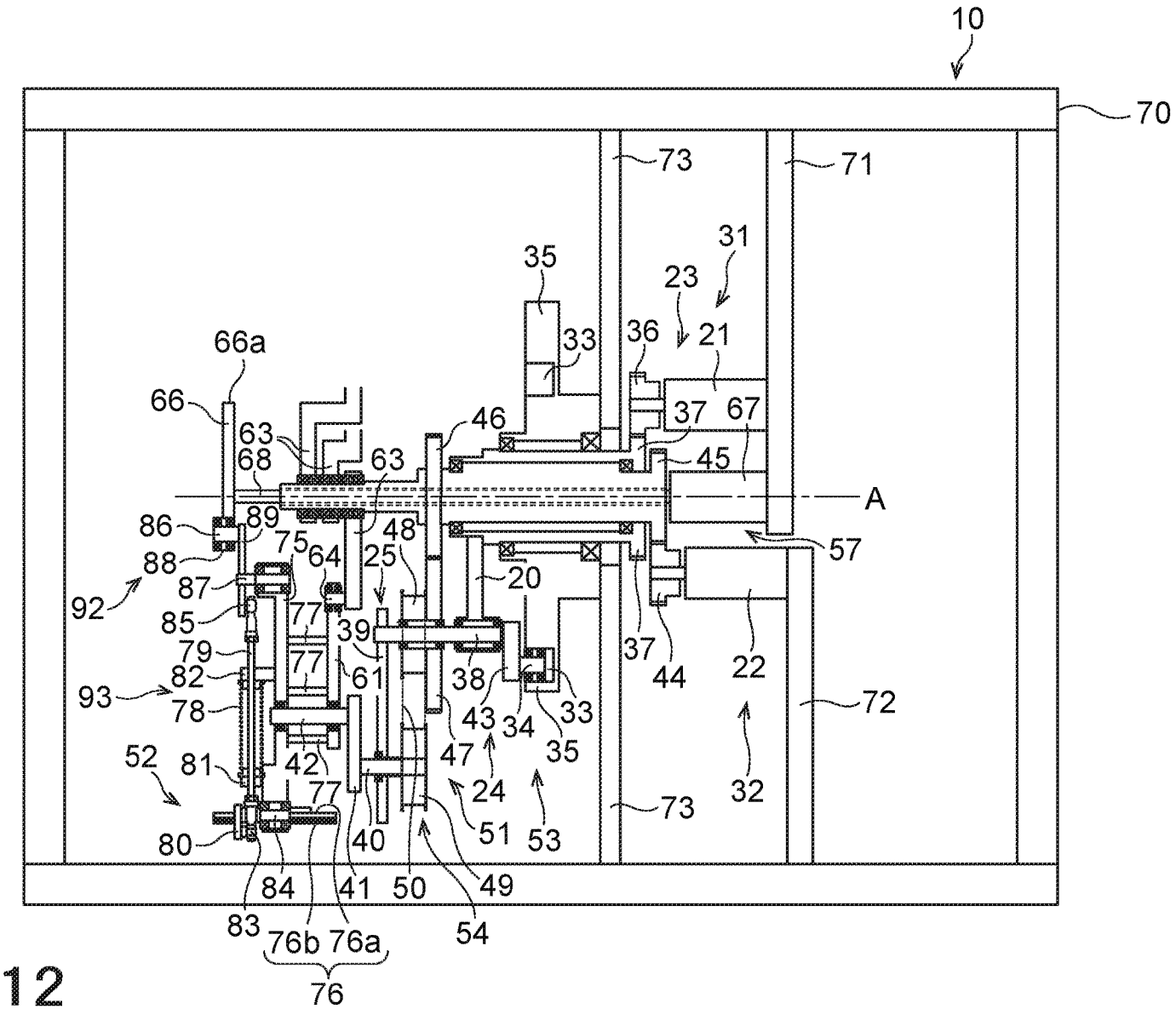
FIG. 12 is a diagram illustrating the transfer mechanism shown in FIGS. 10 and 11 viewed from the side in which a cross-section surface is partially shown.

FIG. 10 is a diagram schematically illustrating the configuration of a bag supply apparatus 100 according to the first variant example. FIG. 11 is a diagram schematically illustrating the configuration of the bag supply apparatus 100 illustrated in FIG. 10, showing a state after the state illustrated in FIG. 10. FIG. 12 is a diagram illustrating the transfer mechanism 10 shown in FIGS. 10 and 11 viewed from the side in which a cross-section surface is partially shown. The same components as those of the bag supply apparatus 100 and the transfer mechanism 10 according to the above-described embodiment are denoted by the same codes, and the detailed description thereof will be omitted. Also, in FIG. 12, a part of the elements provided above the rotational axis A is not shown.

The transfer mechanism 10 according to the present variant example further includes a third driving unit 57 (see FIG. 12) that drives the holding units 52. Each holding unit 52 has a grip unit 76 which is configured so as to be openable and closable. The third driving unit 57 opens and closes the grip units 76. In holding a bag B with a holding unit 52, the grip unit 76 is closed and the bag B is gripped by the grip unit 76. In releasing a bag B from a holding unit 52, the grip unit 76 is opened and the bag B is released from the grip unit 76.

The illustrated third driving unit 57 includes a rotation cam (rotation guide member) 66, a third driving source (guide power unit) 67, guide relay units 92 and open-close units 93.

As shown in FIGS. 10 and 11, the rotation cam 66 has an outer circumferential surface (i.e., the guide surface 66*a*) whose distance from the rotational axis A in a direction perpendicular to the rotational axis A varies with respect to the rotation direction Dt. The rotation cam 66 is provided so as to be rotatable about the rotational axis A independently of the rotation of the main rotation member 20. The third driving source 67 rotates the rotation cam 66 about the rotational axis A. The illustrated third driving source 67 is fixed to the support plate 71, a guide rotation shaft 68 extends from the third driving source 67 on the rotational axis A, and the rotation cam 66 is fixed to the tip portion (i.e., the left side end portion in FIG. 11) of the guide rotation shaft 68. The guide rotation shaft 68 is provided so as to penetrate the second rotating body 45 and not to come into contact with the second rotating body 45. Accordingly, the guide rotation shaft 68 can rotate about the rotational axis A independently of the rotations of the second rotating body 45 and the first rotating body 37.

The guide relay units 92 move on the guide surface 66*a* of the rotation cam 66. The illustrated guide relay units 92 each have a guide lever 89 and a guide roller 88. A second lever support shaft 86 is fixed to one end of the guide lever 89, and a first lever support shaft 85 is fixed to the other end of the guide lever 89. The guide lever 89 is rotatably connected to a chuck plate 75 via a third lever support shaft 87. The third lever support shaft 87 is disposed between the first lever support shaft 85 and the second lever support shaft 86, and is fixed to the guide lever 89. The guide roller 88 is attached to one end portion of the guide lever 89 via the second lever support shaft 86, and is provided so as to be rotatable around the second lever support shaft 86 at a position where the guide roller 88 faces the guide surface 66*a*. The guide lever 89 is attached to the open-close unit 93 via the first lever support shaft 85, and is provided so as to be rotatable around the first lever support shaft 85.

Each open-close unit 93 is connected to a guide relay unit 92 (in particular, a guide lever 89) and a grip unit 76. The open-close unit 93 opens and closes the grip unit 76 according to the distance of the guide relay unit 92 (in particular, the guide roller 88) on the guide surface 66*a* from the rotational axis A. The illustrated open-close unit 93 includes: a connecting member 79; a first connecting block 81 fixed to the connecting member 79; a second connecting block 82 which is fixed to the chuck plate 75 and through which the connecting member 79 penetrates; and a compressed spring 78 provided between the first connecting block 81 and the second connecting block 82.

The connecting member 79 is rotatably connected to the guide lever 89 via the first lever support shaft 85 at one end portion (i.e., at the end portion on the second connecting block 82 side), and is rotatably connected to a chuck support member 80 via a first chuck support shaft 83 at the other end portion (i.e., at the end portion on the first connecting block 81 side). The first chuck support shaft 83 is fixed to the chuck support member 80. Further, the connecting member 79 is provided so as to penetrate the compressed spring 78 and the second connecting block 82, and basically does not contact the compressed spring 78 and the second connecting block 82.

One end portion of the chuck support member 80 is connected to the connecting member 79 via the first chuck support shaft 83, and the grip unit 76 (in particular, a chuck movable member 76*b*) is attached to the other end portion of the chuck support member 80. Further, the chuck support member 80 is rotatably connected to the chuck plate 75 via a second chuck support shaft 84. The second chuck support shaft 84 is provided between the first chuck support shaft 83 and the chuck movable member 76*b*, and is fixed to the chuck plate 75.

The chuck plate 75 is fixed to the mounting plate 61 via connecting shafts 77. Further, the chuck plate 75 rotatably supports the second support shaft 42, and is reinforced by the second support shaft 42. However, the second support shaft 42 may not be supported by the chuck plate 75.

In the transfer mechanism 10 having the above-described configuration, the open-close states of the holding units 52 (specifically, the grip units 76) are determined according to the distances of the corresponding guide rollers 88 from the rotational axis A. When a guide roller 88 is located relatively far from the rotational axis A, the compressed spring 78 is elastically compressed between the first connecting block 81 and the second connecting block 82, and the connecting member 79 moves against the force which is received from the compressed spring 78 via the first connecting block 81 and the second connecting block 82 so as to be disposed on the side relatively away from the grip unit 76 (in other words, on the first lever support shaft 85 side). In this case, the chuck support member 80 connected to the connecting member 79 swings around the second chuck support shaft 84, the chuck movable member 76*b* moves away from the chuck stationary member 76*a*, so that the grip unit 76 is opened. On the other hand, when the guide roller 88 is disposed at a position relatively close to the rotational axis A, the connecting member 79 is disposed on the side relatively close to the grip unit 76 (in other words, on the first chuck support shaft 83 side) by the force which is received from the compressed spring 78 being in a compressed state via the first connecting block 81 and the second connecting block 82. In this case, the chuck support member 80 swings around the second chuck support shaft 84, the chuck movable member 76*b* approaches and contacts the chuck stationary member 76*a*, and finally the grip unit 76 is closed.

In the illustrated transfer mechanism 10, the guide rollers 88 are brought into contact with the guide surface 66*a* and are pressed by the rotation cam 66 in this manner, so that the connecting member 79 moves in a direction away from the grip unit 76 and the grip unit 76 opens. On the other hand, in a state in which the guide roller 88 is not pressed by the rotation cam 66, the connecting member 79 moves in a direction toward the grip unit 76 under the influence of the repulsive force of the compressed spring 78, and the grip unit 76 closes. Accordingly, while the guide roller 88 receives the pressing force from the rotation cam 66, the grip unit 76 is opened, and while the guide roller 88 is not receiving the pressing force from the rotation cam 66 (for example, the guide roller 88 stays away from and does not contact the rotation cam 66), the grip unit 76 is closed.

The other configurations of the transfer mechanism 10 and the bag supply apparatus 100 according to the present variant example are similar to those of the transfer mechanism 10 and the bag supply apparatus 100 according to the above-described embodiment.

Next, the holding actions of the holding units 52 (in particular, the grip units 76) at the pickup position P1 and the delivery position P2 in the transfer mechanism 10 and the bag supply apparatus 100 according to the present variant example will be described.

Also in the transfer mechanism 10 and the bag supply apparatus 100 of this variant example, the movement of each holding unit 52 is stopped or suppressed at each of the pickup position P1, the delivery position P2 and the standby position P3, as a result of the combination of the regulating operations of a first regulating mechanism 53 and a second regulating mechanism 54, as described above. While a holding unit 52 remains at the pickup position P1, the holding unit 52 holds a new bag B. Further, while a holding unit 52 remains at the delivery position P2, the holding unit 52 delivers the bag B to the receiving device 110.

Therefore, at the initial stage while holding units 52 remain at the pickup position P1 and the delivery position P2 respectively, the holding unit 52 disposed at the pickup position P1 does not hold a bag B, and the holding unit 52 arranged at the delivery position P2 is holding a bag B as illustrated in FIG. 10. Specifically, the guide roller 88 connected to the holding unit 52 arranged at the pickup position P1 is in contact with the guide surface 66*a* and is pressed by the rotation cam 66, so that the grip unit 76 is opened. On the other hand, the guide roller 88 connected to the holding unit 52 arranged at the delivery position P2 is not pressed by the rotation cam 66 (more specifically, this guide roller 88 stays away from the guide surface 66*a*), so that the grip unit 76 is closed.

At the middle stage while the holding units 52 remain at the pickup position P1 and the delivery position P2 respectively, a new bag B is disposed between the chuck stationary member 76*a* and the chuck movable member 76*b* of the grip unit 76, which is in an open state, of the holding unit 52 arranged in the pickup position P1 as illustrated in FIG. 10. Further, while the grip unit 76 of the holding unit 52 arranged at the delivery position P2 keeps the state in which the grip unit 76 grips a bag B, the gripper 111 of the receiving device 110 grips the bag B. From the initial stage to the middle stage while the holding units 52 remain at the pickup position P1 and the delivery position P2 respectively, the rotation cam 66 does not rotate and is stationary in the state illustrated in FIG. 10.

In the latter half of the period during which the holding units 52 remain at the pickup position P1 and the delivery position P2 respectively, the rotation cam 66 is rotated by the third driving unit 57 (third driving source 67) under the control of the control unit 90, so that the rotation cam 66 shifts to the rotating state illustrated in FIG. 11. The rotation cam 66 illustrated in FIG. 11 is rotated around the axis by about 70 degrees in the counterclockwise direction from the state illustrated in FIG. 10. As a result, the guide roller 88 connected to the holding unit 52 arranged at the pickup position P1 does not receive the pressing force from the rotation cam 66 (more specifically, this guide roller 88 stays away from the guide surface 66*a*), so that the grip unit 76 is closed and grips the new bag B. In this manner, the holding unit 52 arranged at the pickup position P1 holds the new bag B. On the other hand, the guide roller 88 connected to the holding unit 52 arranged at the delivery position P2 is pressed by the rotation cam 66, so that the grip unit 76 is opened. As a result, the holding unit 52 arranged at the delivery position P2 releases the bag B.

Then, the holding unit 52 holding the new bag B moves from the pickup position P1 toward the delivery position P2. Further, the holding unit 52 having released the bag B moves from the delivery position P2 toward the standby position P3.

By repeating the above-described operations, the transfer mechanism 10 and the bag supply apparatus 100 of the present variant example can also swiftly transfer a bag B from the pickup position P1 to the delivery position P2, and suppress the movement of bags B when those bags are placed at the pickup position P1 and the delivery position P2, as in the above-described embodiment. In particular, in this variant example, since bags B are held by gripping, the holding units 52 can hold bags B in a desired state by an appropriate force.

For example, if a bag B is held by suction as in the above-described embodiment, in order to properly hold a bag B, it might be required to increase the suction force, depending on the bag B (sheet member). In such a case, there is concern that the suction force may become excessive and unnecessary wrinkles may occur in a bag B. Further, in a case where a bag B is held by suction as in the above-described embodiment, if a bag B is made of a relatively soft material, the mouth part of the bag B might be opened while the bag B is transferred from the pickup position P1 to the delivery position P2. In such a case, there is concern that, when a gripper 111 of the bag supply apparatus 100 grips the bag B at the delivery position P2, wrinkles may occur. Such wrinkles occurring in a bag B not only impair the aesthetic appearance but also can cause troubles in subsequent processing. For example, if vacuum processing is performed in the subsequent stage, there are concerns that the vacuum state of a bag B may not be adequately secured due to such wrinkles or a bag B may not be properly held by a sucker or the like.

On the other hand, since the holding units 52 of the present variant example hold bags B by gripping, there are almost no concerns of occurrence of wrinkles as described above. In particular, by causing each holding unit 52 (grip unit 76) to grip the end portion of a bag B in which the mouth portion is formed, it is possible to prevent the mouth portion from opening during the transferring of the bag B from the pickup position P1 to the delivery position P2, and occurrence of wrinkles in the bag B can be prevented more effectively.

Further, since this variant example employs a simple structure using the rotation cam 66 having the guide surface 66*a* whose distance from the rotational axis A is not constant, the holding units 52 (specifically, the grip units 76) can take appropriate actions at the pickup position P1 and the delivery position P2. The degrees of opening of the grip units 76 at the pickup position P1 and the delivery position P2 may be the same as each other or may be different from each other. Generally, since it is necessary to receive a new bag B between the chuck stationary member 76*a* and the chuck movable member 76*b* at the pickup position P1, it is preferable that the opening degree of the grip units 76 in the pickup position P1 is larger. On the other hand, in the delivery position P2, since it is sufficient for a bag B to be released from each grip unit 76, the opening degree of the grip units 76 may be small or may be smaller than the opening degree of the grip units 76 in the pickup position P1.

The holding units 52 according to the present variant example employ the grip units 76 that grip an end region of a bag B as described above. Therefore, a bag B is disposed in the pickup position P1 in a state where the region of the bag B that can be gripped by the grip units 76 (hereinafter also referred to as "grip region") is exposed. The arrangement conditions of such a bag B in the pickup position P1 is not limited. For example, a placement member (not illustrated) on which only one bag B is placed is provided in the pickup position P1, a notch is formed in the placement member, and the region of a bag B which is exposed to the outside through the notch may be used as the grip region. A large number of bags B arranged in the placement unit 105 (see FIG. 1) may be taken out one by one from the placement unit 105 by a pickup device (not illustrated) and placed on the placement member. Further, the position of a bag B may be adjusted by a positioning unit (not illustrated), and the bag B may be placed on the placement member in a desired position and with a desired posture.

Other Variant Examples

For example, in the above-described embodiment, the holding units 52 are substantially stopped for a temporary period of time at all of the pickup position P1, the delivery position P2 and the standby position P3; however, the holding units 52 may be substantially stopped for a temporary period of time at some of the pickup position P1, the delivery position P2 and the standby position P3 (preferably, at a position(s) including the delivery position P2). In this case, by providing a first driving unit 31 and a second driving unit 32 for each holding unit 52 and each support mechanism 51, it is possible to individually drive a plurality of holding units 52 and a plurality of supporting mechanisms 51.

Further, in the above-described embodiment, the first driving source 21 is used as a power source of the first driving unit 31 and the second driving unit 32 (in particular, the first regulating mechanisms 53), but the first driving source 21 may be used as only a power source of the first driving unit 31, and a power source of the first regulating mechanisms 53 (in other words, a fourth driving source 28 (see FIG. 3; e.g., a servo motor)) may be separately provided. In this case, the transfer mechanism 10 includes the first driving source 21, the second driving source 22, and the fourth driving source that output power. The first driving unit 31 includes the main power transmission system 23, and the power output from the first driving source 21 is transmitted to the main rotating member 20 by the main power transmission system 23 so as to rotate the main rotating member 20 in the first rotation direction Dt1. On the other hand, the second driving unit 32 includes: the first power transmission system 24 that transmits the power output from the fourth driving source 28 to the first regulating mechanisms 53; and the second power transmission system 25 that transmits the power output from the second driving source 22 to the second regulating mechanisms 54. Therefore, the main rotating member 20 is driven based on the power output from the first driving source 21, the first regulating mechanisms 53 are driven based on the power output from the fourth driving source 28, and the second regulating mechanisms 54 are driven based on the power output from the second driving source 22.

Further, the number of holding units 52 (specifically, the support mechanisms 51 and the holding units 52) is not limited, and only one holding unit 52 may be connected to the main rotating member 20, two holding units 52 may be connected to the main rotating member 20, or four or more holding units 52 may be connected to the main rotating member 20.

Also, the specific directions of the first regulating direction Dr1 and the second regulating direction Dr2 are not limited. For example, when one of the first regulating direction Dr1 and the second regulating direction Dr2 may be a radiation direction (that is, a radial direction) with reference to the rotational axis A or a direction close to the radiation direction, and the other regulating direction may be a direction perpendicular to the radiation direction (that is, a tangential direction) or a direction close to the tangential direction.

Further, the suction members 62 are not limited to suction cups, and bags B may be held using a method other than suction.

In the above embodiment, when the rotational angular position of the main rotating member 20 is in the angular range including 0 degrees (see FIG. 8A) to 30 degrees (see FIG. 8B), the movement of the holding units 52 (specifically, the suction members 62) is substantially stopped; however, the range of the rotational angular position of the main rotating member 20 which can substantially stop the movement of the holding units 52 varies depending on the form of the elements constituting the transfer mechanism 10, and is not particularly limited. It is preferable that the range of the rotational angular position of the main rotating member 20 which can substantially stop the movement of the holding units 52 be determined adaptively so as to appropriately cover the period of time required for bags B to be held and delivered in the pickup position P1 and the delivery position P2.

The present invention is not limited to the above-described embodiments and variant examples. For example, various modifications may be made to each of the elements of the embodiments and the variant examples described above. Further, the effects brought about by the present invention are not limited to the above-described effects, and particular effects depending on the specific configuration of each embodiment can be exerted. As described above, various additions, modifications and partial deletions can be made to each of the elements described in the claims, the description, the abstract and the drawings, without departing from the technical idea and gist of the present invention.

The invention claimed is:

1. A transfer mechanism, which moves a sheet member from a pickup position to a delivery position, the transfer mechanism comprising:

a main rotating member;

a first driving unit configured to rotate the main rotating member around a rotational axis in a first rotation direction;

a support mechanism configured to be connected to the main rotating member;

a holding unit configured to be connected to the support mechanism and is configured to hold the sheet member;

a second driving unit configured to drive the support mechanism; and a control unit configured to control the second driving unit, wherein the support mechanism is configured to adjust a relative position of the holding unit with respect to the main rotating member, wherein the support mechanism includes:

a first regulating mechanism configured to at least partly cancel out force transmitted from the main rotating member, for a temporary period time, with respect to a first regulating direction; and a second regulating mechanism configured to at least partly cancel out force transmitted from the main rotating member, for a temporary period time, with respect to a second regulating direction, which is a direction different from the first regulating direction, a second rotation direction being opposite to the first rotation direction around the rotational axis and includes a component of the first regulating direction and a component of the second regulating direction, and wherein the control unit is configured to control the second driving unit in such a manner that, when the sheet member is placed in at least one of the pickup position and the delivery position, the control unit causes the support mechanism to generate a force acting in a first adjustment direction including a component of the second rotation direction so that a position of the holding unit is not substantially changed in a state where the main rotating member rotates around the rotational axis in the first rotation direction.

2. The transfer mechanism as defined in claim 1, wherein a receiving device is provided in a position corresponding to the delivery position, and wherein the control unit is configured to control the second driving unit in such a manner that, when the sheet member is placed in the delivery position, the position of the holding unit is not substantially changed at least during a time when the sheet member is delivered from the holding unit to the receiving device.

3. The transfer mechanism as defined in claim 1, wherein the control unit is configured to control the second driving unit in such a manner that, when the holding unit holds the sheet member placed in the pickup position, the position of the holding unit is not substantially changed for a temporary period of time.

4. The transfer mechanism as defined in claim 2, wherein the control unit is configured to control the second driving unit in such a manner that, when the holding unit holds the sheet member placed in the pickup position, the position of the holding unit is not substantially changed for a temporary period of time.

5. The transfer mechanism as defined in claim 1, wherein the support mechanism is one of a plurality of support mechanisms, wherein the holding unit is one of a plurality of holding units that are connected to the plurality of support mechanisms respectively are provided, and wherein the plurality of holding units are arranged at equal angular intervals in a rotation direction around the rotational axis.

6. The transfer mechanism as defined in claim 2, wherein the support mechanism is one of a plurality of support mechanisms, wherein the holding unit is one of a plurality of holding units that are connected to the plurality of support mechanisms respectively are provided, and wherein the plurality of holding units are arranged at equal angular intervals in a rotation direction around the rotational axis.

7. A transfer mechanism that moves a sheet member from a pickup position to a delivery position, the transfer mechanism comprising:

a main rotating member;

a first driving unit configured to rotate the main rotating member around a rotational axis in a first rotation direction;

a support mechanism connected to the main rotating member;

a holding unit connected to the support mechanism and configured to hold the sheet member;

a second driving unit configured to drive the support mechanism; and a control unit configured to control the second driving unit, wherein the support mechanism configured to adjust a relative position of the holding unit with respect to the main rotating member, wherein the control unit controls the second driving unit in such a manner that, when the sheet member is placed in at least one of the pickup position and the delivery position, a position of the holding unit is not substantially changed in a state where the main rotating member rotates around the rotational axis in the first rotation direction, wherein the support mechanism includes:

a mounting plate which supports the holding unit in a fixed manner;

a first connection body which is provided to be swingable around the rotational axis, one side of the first connection body being rotatably connected to one side of the mounting plate, another side of the first connection body being rotatable around the rotational axis;

a second connection body, one side of the second connection body being rotatably connected to another side of the mounting plate;

a third connection body, one side of the third connection body being rotatably connected to another side of the second connection body; and a fourth connection body which rotates around the rotational axis along with the main rotating member and supports another side of the third connection body in a fixed manner, one side of the fourth connection body being rotatably supported by the main rotating member.

8. The transfer mechanism as defined in claim 2, wherein the support mechanism includes:

a mounting plate configured to support the holding unit in a fixed manner;

a first connection body configured to be swingable around the rotational axis, one side of the first connection body being rotatably connected to one side of the mounting plate, another side of the first connection body being rotatable around the rotational axis;

a second connection body, one side of the second connection body being rotatably connected to another side of the mounting plate;

a third connection body, one side of the third connection body being rotatably connected to another side of the second connection body; and a fourth connection body configured to rotate around the rotational axis along with the main rotating member and support another side of the third connection body in a fixed manner, one side of the fourth connection body being rotatably supported by the main rotating member.

9. A transfer mechanism that moves a sheet member from a pickup position to a delivery position, the transfer mechanism comprising:

a main rotating member;

a first driving unit configured to rotate the main rotating member around a rotational axis in a first rotation direction;

a support mechanism connected to the main rotating member;

a holding unit connected to the support mechanism and configured to hold the sheet member;

a second driving unit configured to drive the support mechanism;

a control unit configured to control the second driving unit; and a third driving unit configured to drive the holding unit, wherein the support mechanism is configured to adjust a relative position of the holding unit with respect to the main rotating member, wherein the control unit is configured to control the second driving unit in such a manner that, when the sheet member is placed in at least one of the pickup position and the delivery position, a position of the holding unit is not substantially changed in a state where the main rotating member rotates around the rotational axis in the first rotation direction, wherein the holding unit has a grip unit is configured to open and close, and wherein the third driving unit is configured to cause the grip unit to open and close in such a manner that, when the holding unit is caused to hold the sheet member, the grip unit is closed in such a manner that the grip unit grips the sheet member, and when the holding unit is caused to release the sheet member, the grip unit is opened in such a manner that the grip unit releases the sheet member.

10. The transfer mechanism as defined in claim 2, comprising a third driving unit configured to drive the holding unit, wherein the holding unit has a grip unit is configured to open and close, and wherein the third driving unit is configured to cause the grip unit to open and close in such a manner that, when the holding unit is caused to hold the sheet member, the grip unit is closed in such a manner that the grip unit grips the sheet member, and when the holding unit is caused to release the sheet member, the grip unit is opened in such a manner that the grip unit releases the sheet member.

11. The transfer mechanism as defined in claim 9, wherein the third driving unit includes:

a rotation guide member, which has a guide surface and is configured to rotate around the rotational axis independently of the main rotating member, a distance of the guide surface from the rotational axis in a direction perpendicular to the rotational axis varying in a rotation direction;

a guide power unit configured to cause the rotation guide member to rotate around the rotational axis;

a guide relay unit configured to move on the guide surface; and an open-close unit configured to be connected to the guide relay unit and the grip unit and configured to cause the grip unit to open and close according to a distance of the guide relay unit on the guide surface from the rotational axis.

12. The transfer mechanism as defined in claim 10, wherein the third driving unit includes:

a rotation guide member which has a guide surface and is configured to rotate around the rotational axis independently of the main rotating member;

a distance of the guide surface from the rotational axis in a direction perpendicular to the rotational axis varying in a rotation direction;

a guide power unit configured to cause the rotation guide member to rotate around the rotational axis;

a guide relay unit configured to move on the guide surface; and an open-close unit configured to be connected to the guide relay unit and the grip unit and configured to cause the grip unit to open and close according to a distance of the guide relay unit on the guide surface from the rotational axis.

13. The transfer mechanism as defined in claim 1, wherein the support mechanism includes:

a guide member has a cam groove;

a cam body configured to be connected to the main rotating member and is placed in the cam groove; and a distance of the cam groove from the rotational axis in a direction perpendicular to the rotational axis varies in a rotation direction, wherein the cam body is guided along the cam groove according to rotation of the main rotating member, and wherein the support mechanism is driven by the second driving unit and is driven according to a position of the cam body in the cam groove.

14. The transfer mechanism as defined in claim 2, wherein the support mechanism includes:

a guide member has a cam groove;

a cam body configured to be connected to the main rotating member and is placed in the cam groove; and a distance of the cam groove from the rotational axis in a direction perpendicular to the rotational axis varies in a rotation direction, wherein the cam body is guided along the cam groove according to rotation of the main rotating member, and wherein the support mechanism is driven by the second driving unit and is driven according to a position of the cam body in the cam groove.

15. A bag supply apparatus comprising:

a transfer mechanism defined in claim 1;

a placement unit configured to place a sheet member in the pickup position; and a receiving device configured to receive a sheet member placed in the delivery position, wherein the sheet member is a bag.

16. A bag supply apparatus comprising:

a transfer mechanism defined in claim 2;

a placement unit configured to place a sheet member in the pickup position; and a receiving device configured to receive a sheet member placed in the delivery position, wherein the sheet member is a bag.

* * * * *